US005266453A

United States Patent [19]

Matushita et al.

[11] Patent Number: 5,266,453

[45] Date of Patent: Nov. 30, 1993

[54] SILVER HALIDE PHOTOGRAPHIC LIGHT-SENSITIVE MATERIAL

[75] Inventors: Tetunori Matushita; Yoko Idogaki, both of Kanagawa, Japan

[73] Assignee: Fuji Photo Film Co., Ltd., Kanagawa, Japan

[21] Appl. No.: 866,517

[22] Filed: Apr. 10, 1992

[30] Foreign Application Priority Data

Apr. 10, 1991 [JP] Japan ..... 3-103584

[51] Int. Cl.[5] ..... G03C 1/06; G03C 1/84

[52] U.S. Cl. ..... 430/517; 430/522; 430/958; 430/955; 430/222; 430/223; 430/224

[58] Field of Search ..... 430/517, 522, 958, 955, 430/222, 223, 224

[56] References Cited

U.S. PATENT DOCUMENTS

| | | | |
|---|---|---|---|
| 4,369,310 | 1/1983 | Postle | 430/522 |
| 4,923,789 | 5/1990 | Yagihara et al. | 430/517 |
| 4,965,170 | 10/1990 | Ukai et al. | 430/958 |
| 5,008,181 | 4/1991 | Ikegawa et al. | 430/958 |
| 5,015,562 | 5/1991 | Toya | 430/517 |

FOREIGN PATENT DOCUMENTS 0280252 8/1988 European Pat. Off. .

*Primary Examiner*—Richard L. Schilling
*Assistant Examiner*—Thomas R. Neville
*Attorney, Agent, or Firm*—Sughrue, Mion Zinn Macpeak & Seas

[57] ABSTRACT

A silver halide photographic light-sensitive material which provides an improved safelight property without adversely affecting the photographic properties of the light-sensitive material. The silver halide photographic light-sensitive material contains at least one compound represented by formula (I):

(I)

wherein $R_1$ and $R_2$ each represent a hydrogen atom or a substitutable group; W represents a nitrogen atom or a carbon atom; Z represents $—Y_1—(R_3)n_2$ or $R_3$ in which $R_3$ represents a hydrogen atom or a substitutable group; $n_0$, $n_1$ and $n_2$ each represents 0 or 1; h represents 1 or 2; $R_1$ and $R_2$ and $R_3$ may combine with each other to form a hydrocarbon ring or a heterocyclic ring; $Y_1$ represents —CO—, —CO(=NR$_4$)—, —C(=S)—, —C(=N+R$_5$R$_6$)—, —SO—, —SO$_2$—, —C(C=CR$_7$R$_8$)—, —R$_6$C=N—, or —R$_6$C=CR$_9$—in $[(R_1)_{n1}—Y_1]$ when $n_1$ is 1 and in $—Y_1—(R_3)_{n2}$ when $n_2$ is 1 in which $R_4$, $R_5$, $R_6$, $R_7$, $R_8$ and $R_9$ each represents a hydrogen atom or a substitutable group, $Y_1$ represents a cyano group or a nitro group in $[(R_1)_{n1}—Y_1]$ when $n_1$ is 0 and in $—Y_1—(R_3)_{n2}$ when $n_2$ is 0; X represents a divalent linkage group; D represents a photographic dye residue; and M represents an amphoteric group having a cationic group and an anionic group.

16 Claims, No Drawings

SILVER HALIDE PHOTOGRAPHIC LIGHT-SENSITIVE MATERIAL

FIELD OF THE INVENTION

The present invention relates to a silver halide photographic light-sensitive material, and more specifically to a silver halide photographic light-sensitive material comprising at least one layer containing a novel light absorbing compound which is discolored by development processing, such that color stain is not generated.

BACKGROUND OF THE INVENTION

Generally, light absorbing compounds are introduced into a silver halide emulsion layer or other hydrophilic colloid layers of a multilayer color light-sensitive material to absorb light of a specific wavelength for sensitivity adjustment, improvement in safelight characteristics, color temperature adjustment of light, prevention of halation, and adjustment of sensitivity balance.

For example, when a silver halide photographic light-sensitive material, which comprises a support having thereon one or more hydrophilic layers such as a light-sensitive silver halide emulsion layer, is subjected to imagewise exposure, it is necessary to control the spectral composition of light incident to the silver halide emulsion layers in order to improve photographic sensitivity. In this case, a dye which absorbs light of a wavelength not used for imaging the silver halide emulsion layer is incorporated into the hydrophilic colloid layers farther from the support than the light-sensitive silver halide emulsion layer to form a filter layer. Light of the desired imaging wavelength alone is transmitted through the filter layer.

An anti-halation layer used to improve the sharpness of an image is provided between a light-sensitive layer and a support or on the backside of the support, to absorb harmful reflected light at the boundary between the emulsion layer and support and on the backside of the support.

Furthermore, a dye which absorbs light in the wavelength region in which silver halide is sensitive is used on occasion to prevent irradiation of a silver halide emulsion layer, to improve the sharpness of the resulting image.

Particularly, a silver halide photographic light-sensitive material for plate making which is used in a light room contains a dye which absorbs UV rays and visible rays in a light-sensitive layer or a layer arranged between the light source and light-sensitive layer to provide increased protection to a safelight.

Furthermore, in an X-ray light sensitive material, a coloring layer may be provided to improve sharpness by decreasing crossover.

The layers to be colored are generally composed of a hydrophilic colloid, and therefore a dye is usually incorporated into the coloring layers. This dye desirably satisfies the following conditions:

(1) appropriate spectral absorption according to the intended use;

(2) photochemically inactive, namely, not adversely affecting the photographic characteristics of a silver halide photographic layer with respect to, for example, sensitivity, latent image stability and fogging;

(3) bleached, dissolved and removed in photographic processing steps without staining a processed photographic light-sensitive layer; and (4) excellent aging stability in a coating liquid (solution) or a silver halide photographic material, with no variation in quality.

Much effort has been made by prior investigators to develop dyes satisfying these requirements. Examples thereof include the pyrazolone oxonol dye described in British Patent 506,385, the barbituric acid oxonol dye described in U.S. Pat. No. 3,247,127, the azo dye described in U.S. Pat. No. 2,390,707, the styryl dye described in U.S. Pat. No. 2,255,077, the hemioxonol dye described in British Patent 584,609, the merocyanine dye described in U.S. Pat. No. 2,493,747, the cyanine dye described in U.S. Pat. No. 2,843,486, and the methylene type benzylidene dye described in U.S. Pat. No. 4,420,555.

When the layers containing the above dyes function as a filter layer and an anti-halation layer, the subject layers must be selectively colored while the remaining layers are not substantially colored. Particularly, if the remaining layers are substantially colored, the dye contained therein exerts a harmful spectral effect. Furthermore, the effectiveness of the filter layer and the anti-halation layer are reduced. Also, if a dye added to a specific layer for preventing irradiation diffuses to color adjacent layers, the problems as described above also arise.

A known method for solving this problem is the method in which an acidic dye having a sulfo group and a carboxyl group is localized in a specific layer with a mordant.

Known mordant agents include a polymer of an ethylenically unsaturated compound having a dialkylaminoalkyl ester residue as described in British Patent 685,475, a reaction product of polyvinylalkylketone and aminoguanidine as described in British Patent 850,281, vinylpyridine polymers and vinylpyridinium cation polymers as described in U.S. Pat. Nos. 2,548,564, 2,484,430, 3,148,061 and The cation type mordants containing secondary and tertiary amino groups, a nitrogen-containing heterocyclic group and the quaternary cationic groups thereof in polymers are used such that the above described acidic dye can be effectively mordanted.

However, when mordants are used, contact the layer containing a dye with the other hydrophilic layers often causes a portion of the dye to diffuse to adjacent layers in some circumstances. It is a matter of course that diffusion of the dye depends on the chemical structure of the mordant, and also on the chemical structure of the dye.

Furthermore, where a polymer mordant is used, staining tends to occur after photographic processing, especially rapid photographic processing, especially, in a shortened processing time. It is considered that although the bonding force of the mordant to the dye is considerably weakened in an alkaline solution such as a developing solution, some bonding force remains such that a portion of the dye or reversibly decolored product remains in the layer containing the mordant.

However, cationic type mordants tend to electrostatically interact with gelatin (often used as hydrophilic colloid) and surfactants having one of an alcolate group, a carboxylate group, a sulfonate group and a sulfate group to thereby deteriorate the coating property under some circumstances.

Furthermore, in the color light-sensitive material, cationic type mordants deteriorate the desilvering property and reduce the sensitivities of adjacent layers.

When using cationic type mordants, the above noted acidic dyes tend to diffuse to other layers. To solve this problem, use of a large quantity of the mordant was considered in order to prevent the diffusion. However, the diffusion was not completely prevented. Furthermore, the layer containing the mordant was thickened, to thereby result in a reduction of sharpness.

Furthermore, in a light-sensitive material used for printing plate making, a cutting reduction procedure is usually carried out in which a reducer solution is used to adjust the density and gradation. An involved problem is that a water soluble iron complex compound contained in this reducer solution as the reducer is electrostatically combined with the above described cationic type mordant to cause yellow stain.

These problems are solved by the dyes described in JP-A-63-280246 (the term "JP-A" as used herein means an unexamined published Japanese patent application), however, in this method desilvering is inadequate, especially when rapid processing is carried out at a low pH.

Furthermore, in a color light-sensitive material, colloidal silver has hitherto been used for absorbing yellow light and preventing halation. However, fogging of the silver halide light-sensitive emulsion layer adjacent to the layer containing the colloidal silver is increased, such that this technique also is not entirely satisfactory.

Also, a known technique is to add a dye in a dispersed solid to retain the dyes in a specific layer in a photographic light-sensitive material, as disclosed in JP-A-56-12639, JP-A-55-155350, JP-A-55-155351, JP-A-52-92716, JP-A-63-197943, JP-A-63-27838, and JP-A-64-40827, EP Patent 0015601B1 and 0276566A1, and published International Application 88/04794.

It is clear, however, that the absorption spectrum of a dye in the form of a dispersed solid is shifted as compared to the same dye dissolved in a solution or dissociated at pH 10. Furthermore, the half value width (HVW) thereof is broadened, as described in the above noted published International Application 88/04794.

While the broadening of the half value width is well adapted for filter applications in which exposure over a wide wavelength range is necessary, the overall absorption value is disadvantageously decreased. Furthermore, in a multilayer silver halide light-sensitive material, a half value width that is too broad is rather disadvantageous in the application thereof as a filter for cutting off light of an undesired wavelength in a spectral sensitivity region of a lower layer, for example, as a yellow filter or a magenta filter and the use of a dye dispersed in a solid form as a safelight filter as described in JP-A-2-110453. Also, where the dye dispersed in a solid form is used for an anti-halation layer for a light-sensitive layer having a very narrow wavelength sensitivity range, or where used for an anti-halation layer when exposing to light of a very narrow wavelength range, the dye having a low absorption value must be used in large quantity. This in turn results in disadvantages such as deteriorated decolorization, a thicker layer and increased cost.

SUMMARY OF THE INVENTION

Accordingly, a first object of the present invention is to provide a silver halide photographic light-sensitive material comprising a hydrophilic layer colored by a dye which is irreversibly bleached in photographic processing, and which dye does not adversely affect photographic properties.

A second object of the present invention is to provide a silver halide photographic light-sensitive material comprising a plurality of hydrophilic colloid layers, wherein a prescribed hydrophilic colloid layer is selectively colored with a dye having excellent discolorization in photographic processing, especially in rapid processing at low pH.

A third object of the present invention is to provide a novel method of fixing a dye to provide a filter layer having a high absorption rate and a narrow wavelength absorption band.

A fourth object of the present invention is to provide a silver halide photographic light-sensitive material having at least one layer colored with a dye, wherein the dye has a controlled interaction with gelatin and a coating aid in the coating solution for the colored layer, and which coating solution provides an improved coating property.

The above objects of the present invention are achieved by providing a silver halide photographic light-sensitive material comprising a support having thereon one or more hydrophilic colloid layers, at least one layer of which is a light-sensitive silver halide emulsion layer, said light-sensitive material containing at least one compound represented by formula (I):

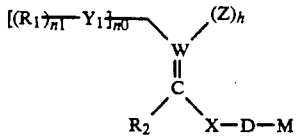

(I)

wherein $R_1$ and $R_2$ each represents a hydrogen atom or a substitutable group; W represents a nitrogen atom or a carbon atom; Z represents $—Y_1—(R_3)n_2$ or $R_3$ in which $R_3$ represents a hydrogen atom or a substitutable group; $n_0$, $n_1$ and $n_2$ each represent 0 or 1; h represents 1 or 2; $R_1$ and $R_2$ and $R_3$ may combine with each other to form a hydrocarbon ring or a heterocyclic ring; $Y_1$ represents —CO—, $—CO(=NR_4)—$, $—C(=S)—$, $—C(=N^+R_5R_6)—$, —SO—, $—SO_2—$, $—C(C=CR_7R_8)—$, $—R_6C=N—$, or $—R_6C=CR_9—$in $[(R_1)_{n1}—Y_1]$ when $n_1$ is 1 and in $—Y_1—(R_3)_{n2}$ when $n_2$ is 1, in which $R_4$, $R_5$, $R_6$, $R_7$, $R_8$ and $R_9$ each represents a hydrogen atom or a substitutable group, and $Y_1$ represents a cyano group or a nitro group in $[(R_1)_{n1}—Y_1]$ when $n_1$ is 0 and in $—Y_1—(R_3)_{n2}$ when $n_2$ is 0; X represents a divalent linkage group; D represents a photographic dye residue; and M represents an amphoteric group having a cationic group and an anionic group.

DETAILED DESCRIPTION OF THE INVENTION

The compound represented by formula (I) can release X—D—M by adding a nucleophilic agent (for example, an $OH^-$ ion, an $SO_3^{-2}$ ion and hydroxylamine) contained in a processing solution to an unsaturated bond during photographic processing (developing, bleaching, fixing and bleach-fixing).

The blocking of an active group utilizing the addition of a nucleophilic agent to an unsaturated bond is described in JP-A-59-201057, JP-A-61-43739, JP-A-61-95347, and JP-A-1-245255.

Next, the compound represented by formula (I) is described in detail below.

$R_1$ represents a hydrogen atom or a substitutable group. The substitutable group represented by $R_1$ is selected from an alkyl group having preferably 1 to 20 carbon atoms, an alkenyl group having preferably 2 to 20 carbon atoms, an aryl group having preferably 6 to 20 carbon atoms, an alkoxy group having preferably 1 to 20 carbon atoms, an aryloxy group having preferably 6 to 20 carbon atoms, an alkylthio group having preferably 1 to 20 carbon atoms, an arylthio group having preferably 6 to 20 carbon atoms, an unsubstituted amino group, a secondary or tertiary amino group substituted preferably with an alkyl group having 1 to 20 carbon atoms or an aryl group having 6 to 20 carbon atoms, and a hydroxy group. The group represented by $R_1$ may be substituted by one or more of the following substituents, and when substituted by two or more substituents, the substituents may be the same or different.

Substituents for the group represented by $R_1$ include, for example, a halogen atom (fluorine, chlorine and bromine), an alkyl group having preferably 1 to 20 carbon atoms, an aryl group having preferably 6 to 20 carbon atoms, an alkoxy group having preferably 1 to 20 carbon atoms, an aryloxy group having preferably 6 to 20 carbon atoms, an alkylthio group having preferably 1 to 20 carbon atoms, an arylthio group having preferably 6 to 20 carbon atoms, an acyl group having preferably 2 to 20 carbon atoms, an acylamino group (preferably an alkanoylamino group having 1 to 20 carbon atoms and a benzoylamino group having 6 to 20 carbon atoms), a nitro group, a cyano group, an oxycarbonyl group (preferably an alkoxycarbonyl group having 1 to 20 carbon atoms and an aryloxycarbonyl group having 6 to 20 carbon atoms), a hydroxy group, a carboxy group, a sulfo group, a ureido group (preferably an alkylureido group having 1 to 20 carbon atoms and an arylureido group having 6 to 20 carbon atoms), a sulfonamide group (preferably an alkylsulfonamide group having 1 to 20 carbon atoms and an arylsulfonamide group having 6 to 20 carbon atoms), a sulfamoyl group (preferably an alkylsulfamoyl group having 1 to 20 carbon atoms and an arylsulfamoyl group having 6 to 20 carbon atoms), a carbamoyl group (preferably an alkylcarbamoyl group having 1 to 20 carbon atoms and an arylcarbamoyl group having 6 to 20 carbon atoms), an acyloxy group (preferably having 1 to 20 carbon atoms), an amino group (which is unsubstituted and a secondary or tertiary amino group substituted preferably with an alkyl group having 1 to 20 carbon atoms or an aryl group having 6 to 20 carbon atoms), a carbonic acid ester group (preferably an alkylcarbonic acid ester group having 1 to 20 carbon atoms and an arylcarbonic acid ester group having 6 to 20 carbon atoms), a sulfone group (preferably an alkylsulfone group having 1 to 20 carbon atoms and an arylsulfone group having 6 to 20 carbon atoms), and a sulfinyl group (preferably an alkylsulfinyl group having 1 to 20 carbon atoms and an arylsulfinyl group having 6 to 20 carbon atoms.

Furthermore, $R_1$ and $R_2$, or $R_2$ and $R_3$, or $R_3$ and $R_1$, or $R_1$, $R_2$, and $R_3$ may be combine to form a hydrocarbon ring or a heterocyclic ring (for example, a 5 to 7-membered ring).

$R_2$ and $R_3$ may be the same or different and each represents a hydrogen atom or a substitutable group. The substitutable group represented by $R_2$ and $R_3$ is selected from a halogen atom (fluorine, chlorine and bromine), an alkyl group having preferably 1 to 20 carbon atoms, an aryl group having preferably 6 to 20 carbon atoms, an alkoxy group having preferably 1 to 20 carbon atoms, an aryloxy group having preferably 6 to 20 carbon atoms, an alkylthio group having preferably 1 to 20 carbon atoms, an arylthio group having preferably 6 to 20 carbon atoms, an acyloxy group having preferably 2 to 20 carbon atoms, an unsubstituted amino group, a secondary or tertiary amino group substituted preferably with an alkyl group having 1 to 20 carbon atoms or an aryl group having 6 to 20 carbon atoms, a carbonamide group (preferably an alkylcarbonamide group having 1 to 20 carbon atoms and an arylcarbonamide group having 6 to 20 carbon atoms), a ureido group (preferably an alkylureido group having 1 to 20 carbon atoms and an arylureido group having 6 to 20 carbon atoms), a carboxy group, a carbonic acid ester group (preferably an alkylcarbonic acid ester group having 1 to 20 carbon atoms and an arylcarbonic acid ester group having 6 to 20 carbon atoms), an oxycarbonyl group (preferably an alkoxycarbonyl group having 1 to 20 carbon atoms and an aryloxycarbonyl group having 6 to 20 carbon atoms), a carbamoyl group (preferably an alkylcarbamoyl group having 1 to 20 carbon atoms and an arylcarbamoyl group having 6 to 20 carbon atoms), an acyl group (preferably an alkylcarbonyl group having 1 to 20 carbon atoms and an arylcarbonyl group having 6 to 20 carbon atoms), a sulfo group, a sulfonyl group (preferably an alkyl-sulfonyl group having 1 to 20 carbon atoms and an arylsulfonyl group having 6 to 20 carbon atoms), a sulfinyl group (preferably an alkylsulfinyl group having 1 to 20 carbon atoms and an arylsulfinyl group having 6 to 20 carbon atoms), a sulfamoyl group (preferably an alkylsulfamoyl group having 1 to 20 carbon atoms and an arylsulfamoyl group having 6 to 20 carbon atoms), a cyano group, and a nitro group.

The substitutable groups represented by $R_2$ and $R_3$ may be substituted by one or more substituents, and when substituted by two or more substituents, the substituents may be the same or different. Examples thereof are the same substituents as those defined for $R_1$.

$Y_1$ represents —CO—, —CO(=$NR_4$)—, —C(=S)—, —C=$N^+R_5R_6$)—, —SO—, —$SO_2$—, —C(C=$CR_7R_8$)—, —$R_6$C=N—, or —$R_6$C=$CR_9$—in $[(R_1)_{n1}—Y_1]$ when $n_1$ is 1 and in —$Y_1$—$(R_3)_{n2}$ when $n_2$ is 1, and a cyano group or a nitro group in $[(R_1)_{n1}—Y_1]$ when $n_1$ is 0 and in —$Y_1$—$(R_3)_{n2}$ when $n_2$ is 0, wherein $R_4$, $R_5$, $R_6$, $R_7$, $R_8$ and $R_9$ may be the same or different from each other and each represent a hydrogen atom or a substitutable group.

The substitutable groups represented by $R_4$, $R_5$, $R_6$, $R_7$, $R_8$ and $R_9$ are selected from a halogen atom (fluorine, chlorine and bromine), an alkyl group having preferably 1 to 20 carbon atoms, an alkenyl group having preferably 2 to 20 carbon atoms, an aryl group having preferably 6 to 20 carbon atoms, an alkoxy group having preferably 1 to 20 carbon atoms, an aryloxy group having preferably 6 to 20 carbon atoms, an acyloxy group having preferably 2 to 20 carbon atoms, an unsubstituted amino group, a secondary or tertiary amino group substituted preferably with an alkyl group having 1 to 20 carbon atoms or an aryl group having 6 to 20 carbon atoms, a carbonamide group (preferably an alkylcarbonamide group having 1 to 20 carbon atoms and an arylcarbonamide group having 6 to 20 carbon atoms), a ureido group (preferably an alkylureido group having 1 to 20 carbon atoms and an arylureido group having 6 to 20 carbon atoms), an oxycarbonyl group (preferably an alkoxycarbonyl group having 1 to 20 carbon atoms and an aryloxycarbonyl group having 6 to 20 carbon atoms), a carbamoyl group (preferably an alkylcarbamoyl group having 1 to 20 carbon atoms and an arylcarbamoyl group having 6 to 20 carbon atoms), an acyl group (preferably an alkylcarbonyl group having 1 to 20 carbon atoms and an arylcarbonyl group having 6 to 20 carbon atoms), a sulfonyl group (preferably an alkylsulfonyl group having 1 to 20 carbon atoms and an arylsulfonyl group having 6 to 20 carbon atoms), a sulfinyl group (preferably an alkylsulfinyl group having 1 to 20 carbon atoms and an arylsulfinyl group having 6 to 20 carbon atoms), a sulfamoyl group (preferably an alkylsulfamoyl group having 1 to 20 carbon atoms and an arylsulfamoyl group having 6 to 20 carbon atoms), a cyano group, and a nitro group. Of these, the preferred substitutable groups for $R_7$ and $R_8$ are selected from an oxycarbonyl group, a carbamoyl group, an acyl group, a sulfonyl group, a sulfamoyl group, a sulfinyl group, a cyano group, and a nitro group. The groups represented by $R_4$ to $R_9$ may be substituted by one or more substituents, and when substituted by two or more substituents, the substituents may be the same or different. Examples of substituents for the groups represented by $R_4$ to $R_9$ are the same as those defined for $R_1$ above.

D represents a photographic dye portion, which by itself can not selectively color a layer containing the dye residue. Also, the dye residue leaves substantially no stain or residual color upon elution from a light-sensitive material or decolorizing reaction in the photographic processing (e.g., developing, bleaching, fixing and washing).

The compound of the present invention is characterized as being fast to diffusion in the blocked state as shown in formula (I), and can selectively color a hydrophilic layer containing the compound, while the dye residue represented by D is diffusible.

Examples of the dye from which the dye residue represented by D is derived are described, for example, in *Photochemicals-Structural Function and Reactive View* (CMC, 1986), pp. 197 to 211.

Useful examples of the dye from which the dye residue represented by D is derived include an arylidene dye, a styryl dye, a butadiene dye, an oxonol dye, a cyanine dye, a merocyanine dye, a hemicyanine dye, a diaryl methane dye, a triaryl methane dye, an azomethine dye, an azo dye, a metal chelate dye, an anthraquinone dye, a stilbene dye, a chalcone dye, an indophenol dye, an indoaniline dye and a coumarin dye.

In addition to the dyes which absorb primarily visible light of a long wavelength range, the dyes from which the dye residue represented by D is derived include as well those dyes which absorb primarily light of a wavelength range shorter than 400 nm (UV absorbing dyes) and dyes having an absorption in a wavelength range longer than 700 nm (infrared dyes). Useful UV dyes, include, for example, an arylidene dye, a butadiene dye, and a coumarin dye. Useful infrared dyes, include, for example, an oxonol dye, a cyanine dye, a merocyanine dye, a hemicyanine dye, a metal chelate dye, a triaryl methane dye, an anthraquinone dye, and an indoaniline dye.

X represents a divalent linkage group, which can split from the compound represented by formula (I) in the form of —X—D—M. Useful divalent linkage groups represented by X include, for example, —O—, —OCO—, —$SO_2$—and —$OSO_2$—.

M represents an amphoteric group having a cationic group and an anionic group. Preferably, M is represented by one of formulae (II) and (III) below:

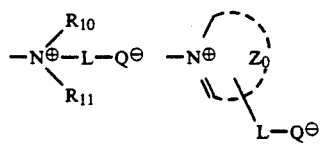

(II)

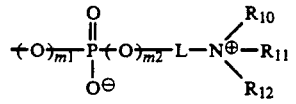

(III)

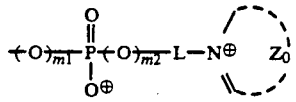

wherein $R_{10}$, $R_{11}$ and $R_{12}$ each represents a substituted or unsubstituted alkyl group having preferably 1 to 6 carbon atoms, an aromatic group having preferably 6 to 10 carbon atoms, an acyl group having preferably 2 to 10 carbon atoms, and a sulfonyl group having preferably 1 to 10 carbon atoms, provided that $R_{10}$ and $R_{11}$, $R_{10}$ and $R_{12}$, $R_{11}$ and $R_{12}$ or $R_{10}$, $R_{11}$ and $R_{12}$ may combine to form a hetero ring (for example, a 5 to 10-membered ring) (e.g., pyrrole, imidazole, pyrazole, pyrrolidine, piperidine and morpholine); L represents a divalent linkage group (e.g., a linear or branched alkylene group having preferably 1 to 6 carbon atoms, a linear or branched alkenylene group having preferably 2 to 6 carbon atoms, and an arylene group (preferably a benzylidene group)); $Z_0$ represents a group of atoms necessary to form a 5 to 7-membered hetero ring (e.g., oxazole, thiazole, pyridine, pyridazine, pyrimidine, pyrazine, and triazine); $m_1$ and $m_2$ each are 0 or 1, provided that $m_1+m_2$ is 1; and $Q^-$ represents an anion of carboxylic acid, sulfonic acid, sulfinic acid or phosphoric acid.

The compounds of formula (I) are preferably represented by formulae (IV) and (V):

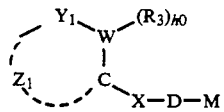

(IV)

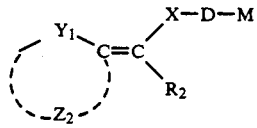

(V)

In formulae (IV) and (V), $Y_1$ represents the same groups as defined in formula (I) where $n_0$ represents 1.

In formula (IV), $Z_1$ represents a group of atoms necessary for forming a hydrocarbon ring or a hetero ring; W represents a carbon atom or a nitrogen atom; $R_3$, $Y_1$, X, D and M represent the same groups as those defined for $R_3$, $Y_1$, X, D and M, respectively, in formula (I); and $h_0$ is 0 or 1.

Examples of the hydrocarbon and hetero rings formed by $Z_1$ (for example, a 5 to 10-membered ring) include cyclopentenone, cyclohexenone, cycloheptenone, benzocycloheptenone, benzocyclopentenone, benzocyclohexenone, 4-pyridone, 4-quinolone, quinone, 2-pyrone, 4-pyrone, 1-thio-2-pyrone, 1-thio-4-pyrone, coumarin, chromone, uracil, imidazoline, thiazoline, oxazoline, pyrrole, oxazole, thiazole, imidazole, triazole, tetrazole, pyridine, pyrimidine, pyrazine, pyridazine, triazine, and the rings formed by condensing the respective hetero rings at appropriate positions, examples of which include quinoline, isoquinoline, phthalazine, quinazoline, quinoxaline, benzothiazole, benzoxazole, benzimidazole, naphthylizine, thiazolo[4,5-d]pyrimidine, 4H-pyrido[1,2-a]pyrimidine, imidazo[1,2-a]pyridine, pyrrolo[1,2-a]-pyrimidine, 1H-pyrrolo[2,3-b]pyridine, 1H-pyrrolo[3,2-b]pyridine, 6H-pyrrolo[3,4-b]pyridine, benzimidazole, triazaindenes (for example, pyrido[3,4-d]pyridazine, pyrido[3,4-d]pyrimidine, imidazo[1,5-a]pyrimidine, pyrazolo[1,5-a]pyrimidine, 1H-imidazo[4,5-b]pyridine, and 7H-pyrrolo[2,3-d]-pyrimidine), tetraazaindenes (for example, pteridine, 4H-imidazo[1,2-b][1,2,4]triazole, imidazo[4,5-d]imidazole, 1H-1,2,4-triazolo[4,3-b]pyridazine, 1,2,4-triazolo[1,5-a]pirimidine, imidazo[1,2-a]-1,3,5-triazine, pyrazolo[1,5-a]-1,3,5-triazine, 7H-purine, 9H-purine, and 1H-pyrazolo[3,4-d]pyrimidine), and pentazaindenes (for example, [1,2,4]triazolo[1,5-a][1,3,5]triazine, 1,2,4-triazolo[3,4-f][1,2,4]triazine, and 1H-1,2,3-triazolo[4,5-d]pyrimidine. In addition to the above rings, the following rings can also be formed by $Z_1$:

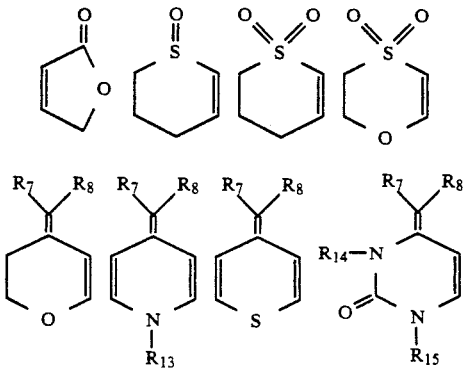

-continued

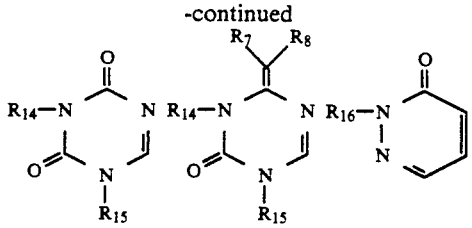

wherein $R_7$ and $R_8$ each represent the same groups as those defined for $R_7$ and $R_8$ in formula (I); and $R_{13}$, $R_{14}$, $R_{15}$ and $R_{16}$ each represent a hydrogen atom, a $C_{1-20}$ alkyl group, a $C_{2-20}$ alkenyl group, a $C_{6-20}$ aryl group, a $C_{7-20}$ aralkyl group, and a $C_{1-20}$ acyl group.

Among the hydrocarbon and hetero rings formed by $Z_1$, cyclopentenones, cyclohexenones, quinones, coumarins, chromones, uracils, and nitrogen-containing aromatic heterocycles are more preferred.

Of the nitrogen-containing aromatic heterocycles, particularly preferred are pyridine, pyrimidine, pyrazine, triazine, quinoline, quinazoline, quinoxaline, triazaindenes, tetrazaindenes, and pentazaindenes. Among them, triazaindenes, tetrazaindenes, and pentazaindenes are preferred.

Preferred substituents for $R_3$ include a halogen atom, an arylthio group, an oxycarbonyl group, a carbamoyl group, an acyl group, a sulfonyl group, a sulfamoyl group, a sulfinyl group, a nitro group, and a cyano group.

Further, $Z_2$ in formula (V) represents the same atomic groups as those defined for $Z_1$ in formula (IV) and $R_2$, $Y_1$, X, D and M represent the same groups as those defined for $R_2$, $Y_1$, X, D and M, respectively, in formula (I).

For example, as the hydrocarbon and heterocyclic rings formed by $Z_2$ (for example, a 5 to 10-membered ring) include cyclopentanone, cyclohexanone, cycloheptanone, benzocycloheptanone, benzocyclopentanone, benzocyclohexanone, 4-tetrahydropyridone, 4-dihydroquinolone, and 4-teterhydropyrone. Of them, cyclohexanones and cyclopentanones are preferred.

Useful examples of the compound represented by formula (I) for use in the present invention are shown below, but the present invention should not be construed as being limited thereto.

(1)

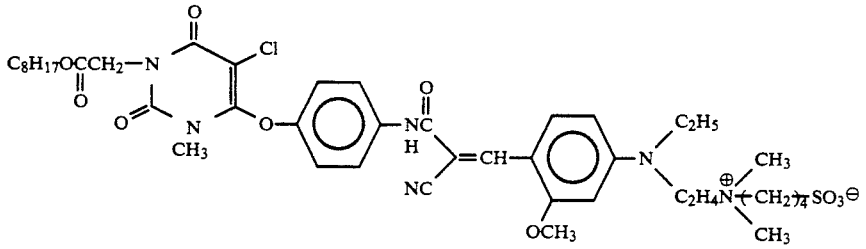

(2)

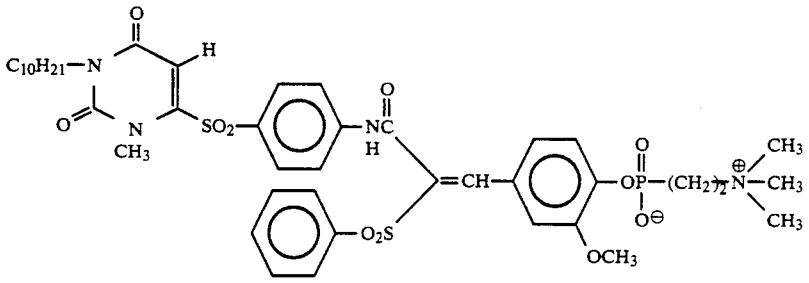

-continued
(3)
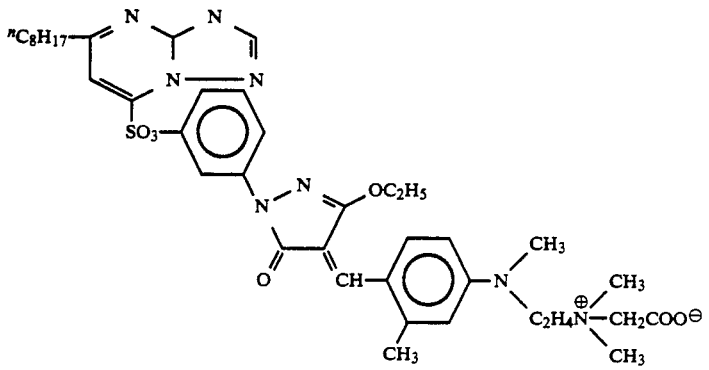
(4)
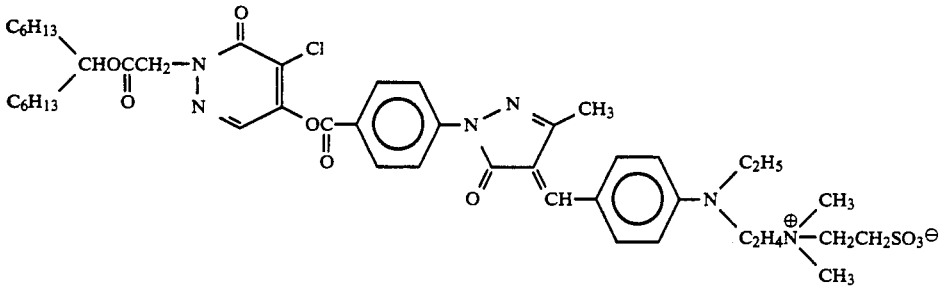
(5)
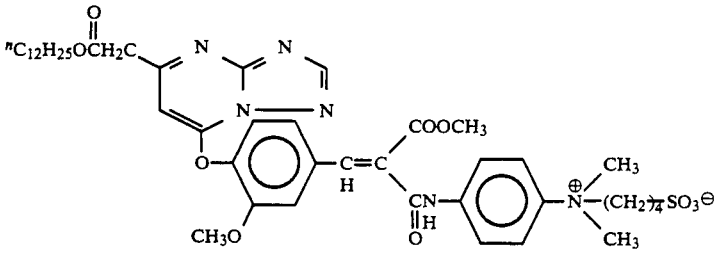
(6)
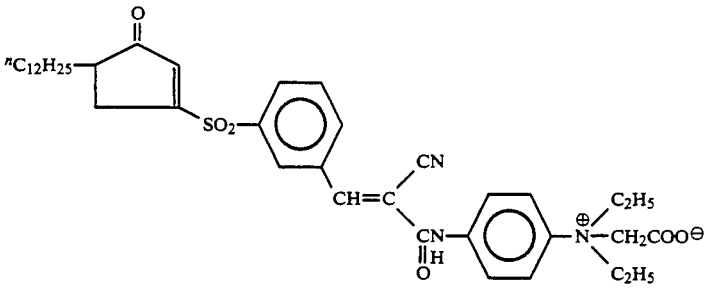
(7)
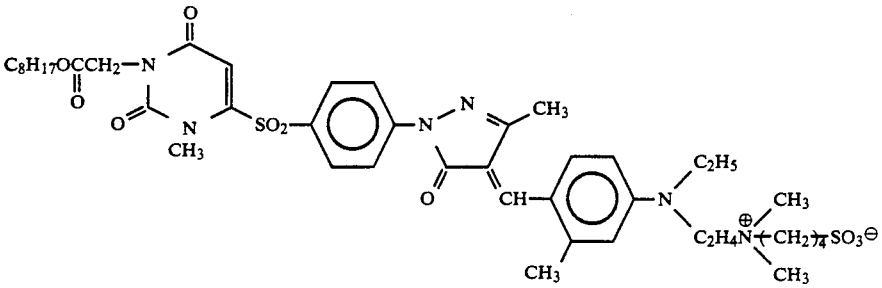

-continued
(8)
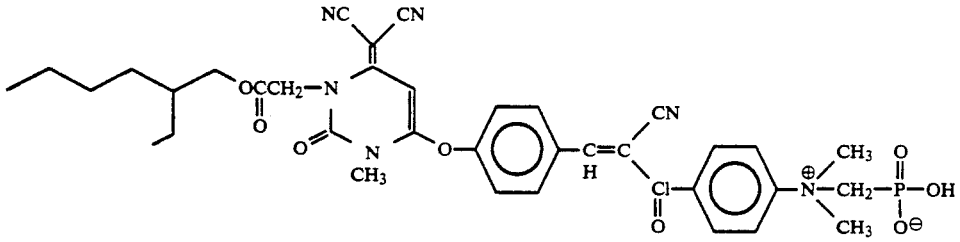
(9)
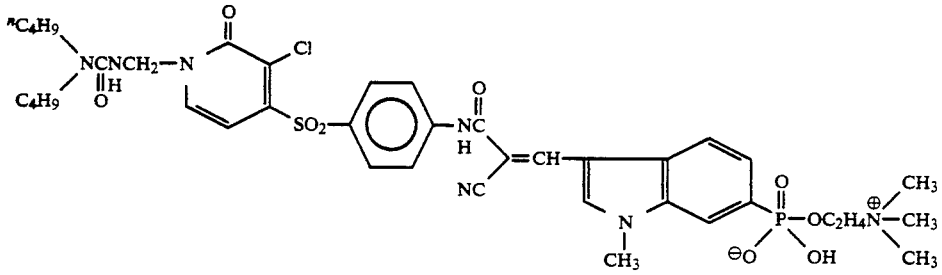
(10)
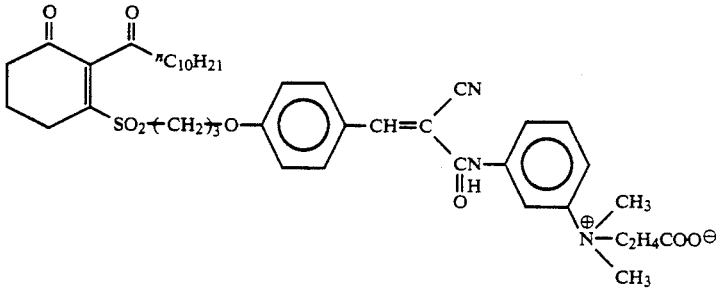
(11)
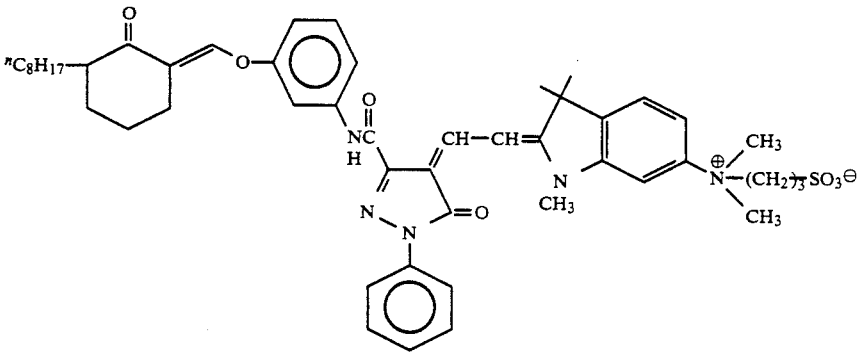
(12)
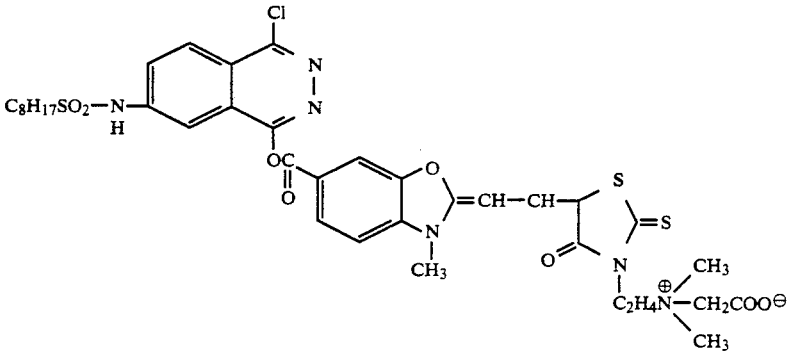

-continued
(13)
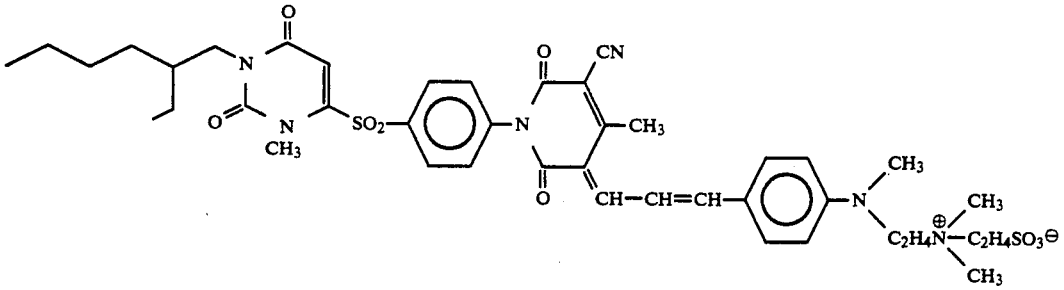
(14)
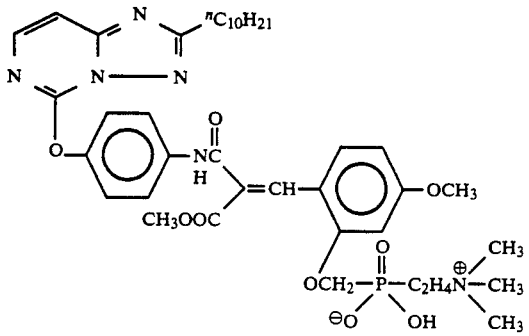
(15)
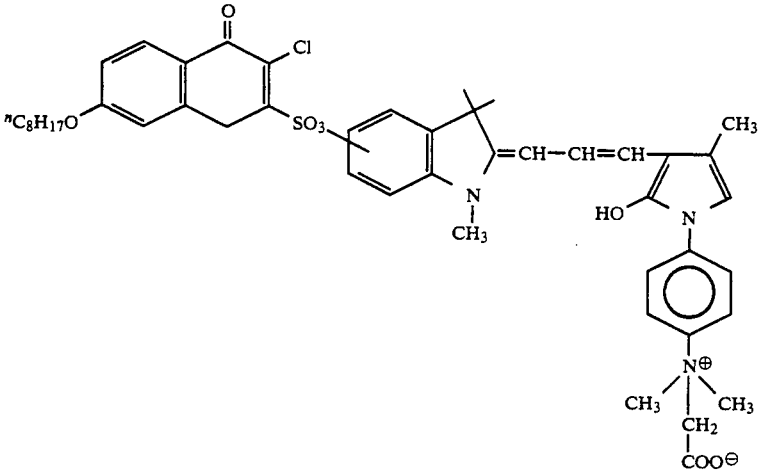
(16)
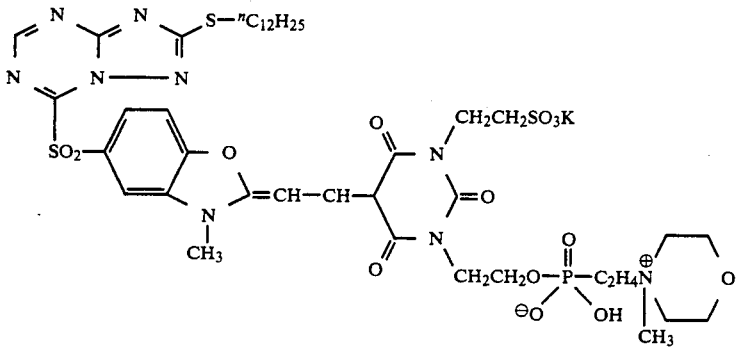

-continued

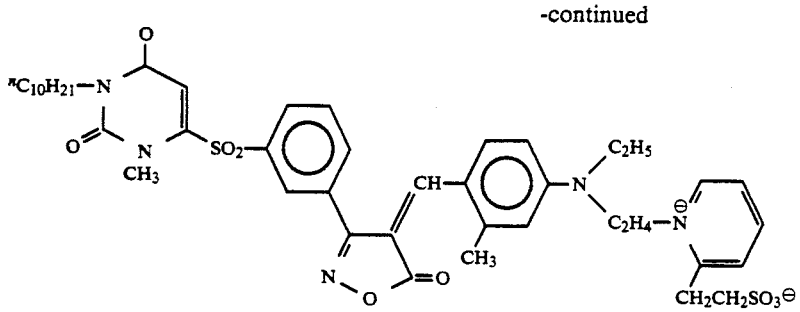

(17)

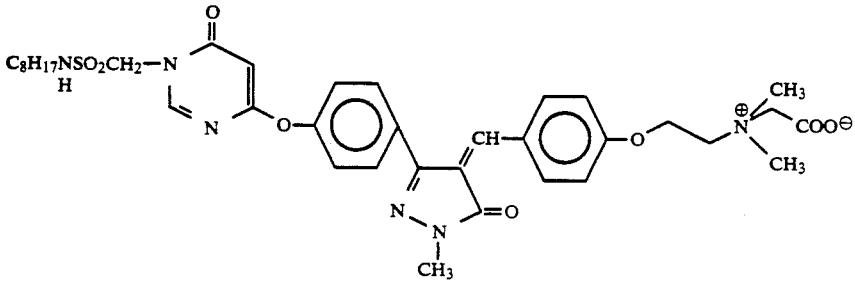

(18)

Synthesis Example-1 (synthesis of Compound (7))

1. Synthesis of a block base

There were added to 150 ml of toluene, 20 g of bromoacetic acid, 20 g of n-octyl alcohol and 2.5 g of p-toluenesulfonic acid, and azeotropical dehydration was carried out for 1.5 hours. After cooling, toluene was distilled off at reduced pressure, and 41 g of n-octyl bromoacetate were obtained by vacuum distillation (110° C., 11 mm Hg).

Next, 15 ml of DBU were added to 15 g of 6-chloro-1-methyluracil suspended in 50 ml of acetonitrile at room temperature to prepare a homogeneous solution. After stirring for 15 minutes, 23.5 g of n-octyl bromoacetate were added dropwise at a room temperature. The solution was stirred at a room temperature for 2.5 hours and dusts were filtered off. Then, acetonirile was distilled off at reduced pressure. Ethyl acetate was added to the residue and deposited DBU.HBr was filtered off. The filtrate was washed with diluted hydrochloric acid, followed by washing with water, and after drying on $MgSO_4$, ethyl acetate was removed at reduced pressure. The residue was refined with silica gel chromatography, whereby 25 g of 6-chloro-1-methyl-3-octyloxycarbomethyluracil were obtained in an oily form. Yield: 91.5%.

2. Synthesis of dye portion

Dropwise added were 480 ml of triethylamine to 400 g of 4-(3-methyl-5-oxo-2-prazoline-1-yl)benzenesulfonic acid suspended in 1.5 liter of acetonitrile at room temperature to prepare a homogeneous solution. After cooling the reaction solution with ice, 300 g of p-toluenensulfonyl chloride were added little by little. After completing the addition, the solution was stirred for one hour while cooling with ice and for another one hour at a room temperature, and then, the deposited hydrochloric acid salt of triethylamine was filtered for removal. The filtrate was condensed, and a mixed solvent of n-hexane/ethyl acetate was added to the residue. After depositing a crystal, the mixture was filtered and dried, whereby 785 g of 4-[3-methyl-5-(4-methylphenylsulfoxy)-2-pyrazolo-1-yl]benezenesulfonic acid triethylamine salt were obtained.

Next, 835 g of 4-[3-methyl-5-(4-methylphenylsulfoxy)-2-pyrazolo-1-yl]benezenesulfonic acid triethylamine salt thus obtained were dissolved in 1.5 liter of acetonitrile without refining, and after cooling with ice, 400 ml of phosphorous oxychloride were added, followed by stirring for 10 minutes.

Next, 500 ml of N,N-dimethylacetamide were slowly added. Afterwards, the solution was stirred for one hour while cooling with ice and then, the reaction solution was poured into 10 kg of ice, followed by adding 10 liters of ethyl acetate for abstraction. The ethyl acetate phase was dried and then, ethyl acetate was distilled off at reduced pressure. The crystal thus obtained was washed with acetonitrile and dried, whereby 580 g of 4-[3-methyl-5-(4-methylphenylsulfoxy)-2-pyrazolo-1-yl]benzenesulfonyl chloride were obtained as a pale yellow crystal. m.p.: 103° C.

Next, 500 g of 4-[3-methyl-5-(4-methylphenylsulfoxy)-2-pyrazolo-1-yl] benzenesulfonyl chloride were added to the aqueous solution prepared by dissolving 427 g of sodium sulfite anhydrous in 2 liters of water. After heating to 50° to 60° C., an aqueous solution of 72 g of sodium hydroxide and 500 ml of water were added dropwise over a period of one hour. Afterwards, the solution was stirred for one hour to make a uniform suspension, and then was left for cooling, followed by filtering to remove insoluble matter and cooling the filtrate with ice. A solution of 93 ml of concentrated sulfuric acid and 200 ml of water was added dropwise to this filtrate for 30 minutes, and the pH of the reaction solution was adjusted to 1 or lower. After stirring for one hour while cooling with ice, deposited crystals were filtered and washed several times with water to remove the inorganic substances, followed by drying, whereby 260 g of 4-(3-methyl-5-oxo-2-pyrazoline-1-yl)benzenesulfinic acid were obtained. This was added slowly to 180 g of 28 wt % sodium methoxide and 2 liters of methanol without refining and completely dissolved in 30 minutes. After filtering to remove dusts, methanol was distilled off at reduced pressure and the residue was washed with acetonitrile, followed by drying, whereby 240 g of sodium 4-(3-methyl-5-oxo-2-pyrazoline-1-yl)benzenesulfinate were obtained as white crystals. mp. 250° C or higher.

Next, 1.7 ml of acetic acid were added to the solution of 9.8 g of 6-chloro-1-methyl-3-octyloxycarbomethyluracil, 7 g of sodium 4-(3-methyl-5-oxo-2-pyrazoline-1-yl) benzenesulfinate and 80 ml of dimethylacetylamide, nd the solution was stirred for three hours at 600° C. After cooling, a saturated salt solution was added thereto and the solution was abstracted twice with 300 ml of ethyl acetate. After washing with water, the organic phase was dried on $MgSO_4$ and ethyl acetate was distilled off at reduced pressure, followed by refining the residue with silica gel chromatography, whereby 9.2 g of an intermediate 1 were obtained in an oily form.

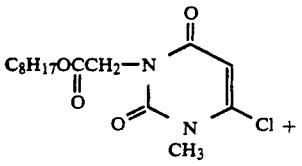

-continued

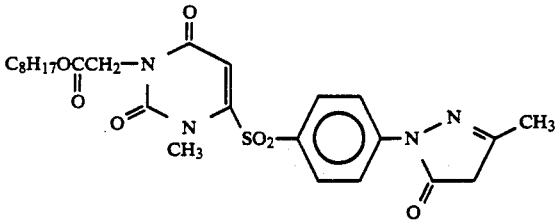

Intermediate I

Next, 2.5 g of the intermediate 1 and 1.23 g of aldehyde 2 were added to 50 ml of methanol and 0.5 g of ammonium acetate, and the solution was heated under refluxing for three hours. After cooling, the reaction solution was condensed and refined with silica gel chromatography, whereby 2.7 g of an intermediate 3 were obtained in an oily form.

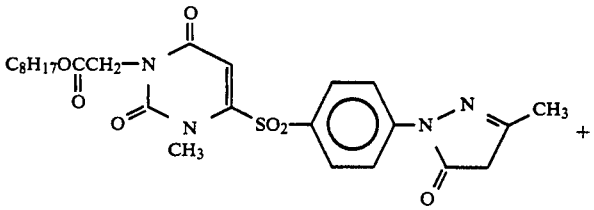

Intermediate I

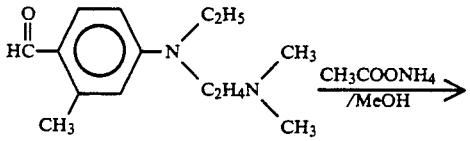

Aldehyde 2

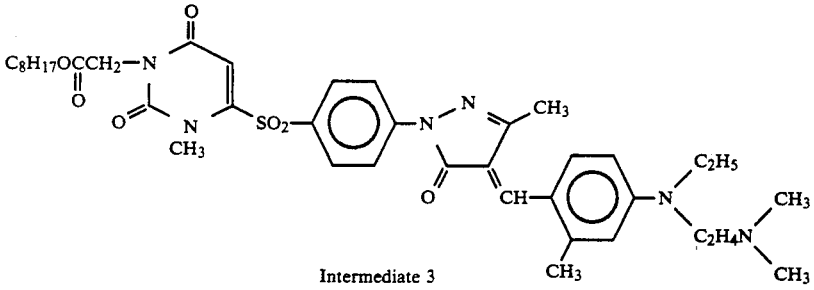

Intermediate 3

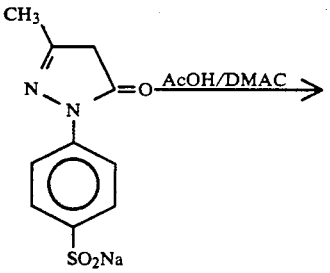

Next, 3 g of the intermediate 3 and 2 g of butanesultone were dissolved in 30 ml of acetonitrile, and the solution was heated under refluxing for 15 hours. After cooling, the deposited crystals were filtered and dried, whereby 2.5 g of the exemplified compound (7) were obtained.

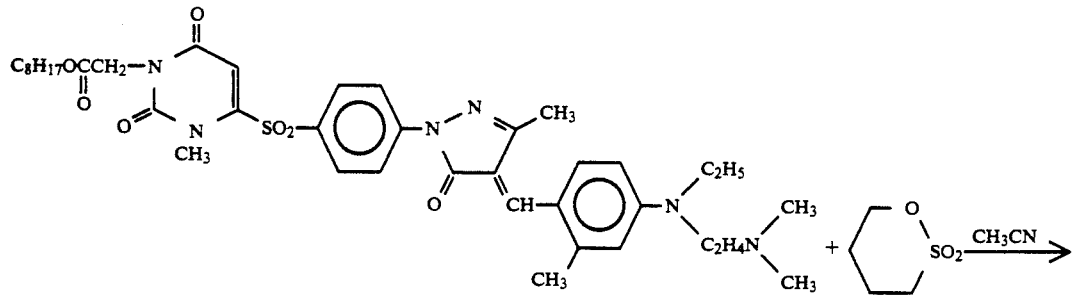

Intermediate 3

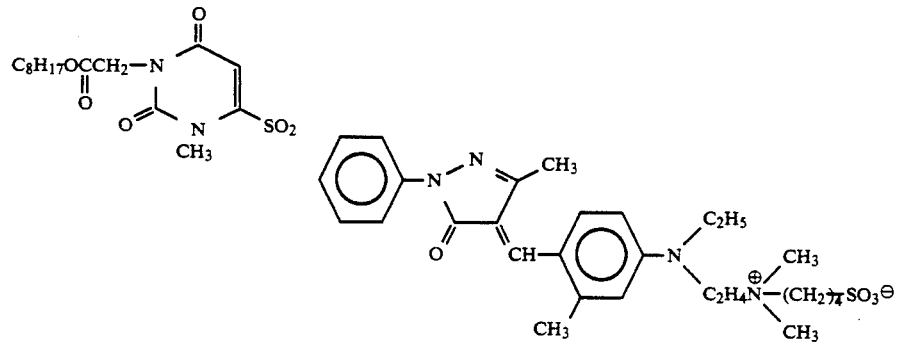

The above described compounds of formula (I) for use in the present invention can be added to a hydrophilic colloid layer in an amount depending on the intended purpose, and preferably in an amount to provide an optical density in the range of 0.05 to 3.0. The precise addition amount depends on the nature of the dye residue contained in the compound represented by formula (I), but is generally $10^{-3}$ to 3.0 g/m$^2$, preferably $10^{-3}$ to 1.0 g/m$^2$ of the light-sensitive material.

The compounds of formula (I) of the present invention can be incorporated into a hydrophilic layer by various known methods.

For example, the compound represented by formula (I) may be dissolved in a suitable solvent, for example, an alcohol such as methanol, ethanol and propanol, acetone, methyl ethyl ketone, methyl cellosolve, dimethylformamide, cyclohexanone, and ethyl acetate, and then dissolved or dispersed in gelatin, or the compound represented by formula (I) may be dissolved in a high boiling oil and added in an emulsified-dispersion of a fine oil drop. Useful oils include tricresyl phosphate, diethyl phthalate, dibutyl phthalate and triphenyl phosphate.

Furthermore, the compound represented by formula (I) can be added by dispersing in an aqueous medium alone or in the presence of an emulsifier or a surfactant with a stirrer, a supersonic mixer, or various mills. As the emulsifier and surfactant, conventional anionic type, nonionic type, cationic type and betain type can be used. Of these, particularly preferred are the anionic type, nonionic type and betain type emulsifiers and surfactants.

The compound represented by formula (I) of the present invention is arranged in the photographic material depending on the intended purpose. For example, the compound represented by formula (I) can be added to a subbing layer, an anti-halation layer provided between a silver halide emulsion layer and a support, a silver halide emulsion layer, an intermediate layer, a protective layer, a back layer provided on the support opposite the silver halide emulsion layer, and a hydrophilic colloid contained in another auxiliary layer.

The compound represented by formula (I) may also be contained in one or more layers as required, or different compounds represented by formula (I) may be contained in the same layer or different layers independently or in combination thereof.

Further, the compound represented by formula (I) of the present invention can be used in combination with various water-soluble dyes, water-soluble dyes adsorbed onto a mordant, dyes dispersed in an emulsion or dyes dispersed in a solid form according as needed.

Gelatin is the most preferable as a hydrophilic colloid, and various known gelatins can be used. For example, there can be used lime-treated gelatin and acid-treated gelatin each manufactured by different production processes, and gelatins prepared by chemically modifying above gelatins to phthalic or sulfonyl derivatives. Also, gelatins which are subjected to a desalting treatment can be used as needed.

The addition ratio of the compounds of formula (I) of the present invention to gelatin within the same layer depends on the structure and amount of the compound, and is preferably in the range of from $1/10^3$ to [illegible] by weight.

Since the compounds of formula (I) of the present invention can be decomposed or eluted mainly with hydroquinone, sulfites or alkali by subjecting the layer containing the above compounds, e.g., to a development processing containing hydroquinone, sulfite or alkali, coloring and stain are not formed on a photographic image. The time necessary for decolorization during the processing varies depending on the concentration of hydroquinone contained in a developing bath or other processing baths, the amount of nucleophilic agents such as sulfites, alkali and others, the kind, amount and addition point in the processing sequence of the above compounds, the amount and swelling rate of the hydrophilic colloid and the degree of stirring. Although the decolorization time is difficult to predict, it can be controlled according to general principals of physical chemistry.

The pH range of the processing solution used to decompose or elute the compound of formula (I) varies depending on whether developing, bleaching and fixing is carried out, and is usually 3.0 to 13.0, preferably 5.0 to 12.5. Accordingly, the compounds of the present invention are characterized in that they can be processed in a processing solution having a relatively low pH to release a dye unit.

The silver halide emulsion for use in the present invention preferably comprises silver bromide, silver iodobromide, silver iodochlorobromide, silver chlorobromide, or silver chloride.

The silver halide grains for use in the present invention can constitute regular crystals such as a cube and octahedron, irregular crystals such as a sphere and plate, or composite crystals thereof. Emulsions comprising a mixture of grains having various crystal forms can also be used. Silver halide grains having a regular crystal forms are preferably used.

The silver halide grains for use in the present invention may have a structure in which the composition of the core portion is different from that of the shell, or a structure in which the composition is uniform throughout the grains. Also, the silver halide grains may be of the type in which a latent image is formed primarily on the surface thereof (for example, a negative type emulsion), or of the type in which the latent image is formed primarily in the inside thereof (for example, an inner latent image type emulsion and pre-fogged direct reversal type emulsion). Preferred are the grains in which a latent image is formed primarily on the surface thereof.

The silver halide emulsion for use in the present invention preferably comprises tabular grains having a thickness of 0.5 μm or less, preferably 0.3 μm or less, a diameter of preferably 0.6 μm or more, and an average aspect ratio of 5 or more accounting for 50% or more of the entire projection area of the grains. Also preferred is a monodisperse emulsion having a statistical variation coefficient of 20% or less, wherein the variation coefficient is obtained by dividing the standard deviation in the distribution of the diameters of the circles corresponding to the areas of the grains by the average diameter. Also, the emulsion may be prepared by mixing a tabular grain emulsion and a monodisperse emulsion.

The photographic emulsions for use in the present invention can be prepared by the methods described, e.g., in *Chimie et Physique Photographique* written by P. Glafkides (published by Paul Montel Co., 1967), and *Photographic Emulsion Chemistry* written by G. F. Duffin (published by The Focal Press, 1966), and *Making and Coating Photographic Emulsion* written by V. L. Zelikman et al (published by The Focal Press, 1964).

During grain formation, in order to control the growth of the silver halide grains, there can be used as a silver halide solvent, for example, ammonia, potassium rhodanide, ammonium rhodanide, thioether compounds (for example, U.S. Pat. Nos. 3,271,157, 3,574,628, 3,704,130, 4,297,439, and 4,276,374), thione compounds (for example, JP-A-53-144319, JP-A-53-82408 and JP-A-55-77737), and amine compounds (for example, JP-A-54-100717).

Cadmium salts, zinc salts, thalium salts, iridium salts or complex salts thereof, rhodium salts or complex salts thereof, and iron salts or complex salts thereof may be present in the step of silver halide grains formation or physical ripening.

In order to harden the gradation of a silver halide photographic light-sensitive material for use in photographic plate making, which is a preferred embodiment of the present invention, hydrazine derivatives or tetrazolium compounds can be used.

Gelatin is advantageously used as a binder or protective colloid for an emulsion layer and an intermediate layer of the light-sensitive material of the present invention. Hydrophilic colloids other than gelatin can also be used including, for example, proteins such as gelatin derivatives, graft polymers of gelatin and other polymers, albumin and casein; cellulose derivatives such as hydroxyethyl cellulose, caboxymethyl cellulose and cellulose sulfuric acid esters; sucrose derivatives such as sodium alginate and starch derivatives; and various synthetic hydrophilic alcohol, partially-acetalized vinyl alcohol, N-vinylpyrrolidone, acrylic acid, methacrylic acid, acrylamide, vinylimidazole, and vinylpyrazole.

Acid-treated gelatin and enzyme-treated gelatin as described in Bull. Soc. Sci. Phot. Japan, No. 16, pp. 30 (1966), as well as conventional lime-treated gelatin and a hydrolysis product of gelatin can be used as well.

Inorganic or organic hardeners may be incorporated as needed into various hydrophilic layers constituting the photographic light-sensitive layer and a back layer of the light-sensitive material of the present invention. For example, useful hardeners include chromium salts, aldehydes (formaldehyde, glyoxal and glutaric aldehyde), and N-methylol compounds (dimethylol urea). Preferred are active halogen compounds (2,4-dichloro-6-hydroxy-1,3,5-triazine and a sodium salt thereof), and active vinyl compounds[1,3-bis(vinylsulfonyl)-2-propanol, 1,2-bis(vinylsulfonylacetamide) ethane, bis(-vinylsulfonylmethyl) ether, and vinyl polymers having a vinylsulfonyl group on a side chain] which harden hydrophilic colloids such as gelatin and provide the stable photographic properties. N-carbamoylpyridinium salts [(1-morphorinocarbonyl-3-pyridinio)methane sulfonate] and haloamidinium salts [1-(1-chloro-1-pyridinomethylene)pyrolidinium and 2-naphthalenesulfonate] have a fast hardening speed and are excellent hardeners.

The silver halide photographic emulsions for use in the light-sensitive material of the present invention may be sensitized with methine dyes and other sensitizing dyes. Useful sensitizing dyes include a cyanine dye, a merocyanine dye, a composite cyanine dye, a composite merocyanine dye, a holopolarcyanine dye, a hemicyanine dye, a styryl dye, and a hemioxonol dye. Particularly useful dyes are a cyanine dye, a merocyanine dye, and a composite merocyanine dye. Any of known nuclei generally employed in cyanine dyes can be applied to the sensitizing dyes for use in the present invention as a basic heterocyclic ring nucleus, including, for example, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; the nucleus formed by condensing these nuclei with alicyclic hydrocarbon rings; and the nucleus formed by condensing these nuclei with aromatic hydrocarbon rings, namely, an indolenine nucleus, a benzindolenine nucleus, an indole ring, a benzoxazole nucleus, a naphthoxazole nucleus, a benzothiazole nucleus, a naphtothiazole nucleus, a benzoselenazole nucleus, a benzimidazole nucleus, and a qunoline nucleus. These nuclei may be substituted on the carbon atoms thereof.

The 5 to 6-membered heterocyclic ring nuclei such as a pyrazoline-5-one nucleus, a thiohydatoin nucleus, a 2-thioxazolidine-2,4-dione nucleus, a thiazolidine-2,4-dione nucleus, a rhodanine nucleus, and a thiobarbituric acid nucleus can be applied to the merocyanine dyes or composite merocyanine dyes as a nucleus having a keto-methylene structure.

These sensitizing dyes may be used alone or in combination thereof. A combination of the sensitizing dyes is often used particularly for supersensitization. In addition to the sensitizing dyes, the silver halide emulsions may contain dyes having no spectral sensitization property of their own, or substances which substantially absorb no visible rays, which dyes and substances promote a supersensitization effect. For example, the silver halide emulsion may contain aminostilbene compounds substituted with a nitrogen-containing heterocyclic nucleus group (described, for example, in U.S. Pat. Nos. 2,933,390 and 3,635,721), aromatic organic acid formaldehyde condensed compounds (described, for example, in U.S. Pat. No. 3,743,510), cadmium salts, and azaindene compounds. Particularly useful are the combinations described in U.S. Pat. Nos. 3,615,613, 3,615,641, 3,617,295, and 3,635,721.

The photographic emulsions for use in the present invention can contain various compounds for preventing fog in preparing, storing and photographically processing the light-sensitive material, and for stabilizing the photographic properties. Known anti-foggants and stabilizers, for addition to the photographic emulsions include, e.g., azoles, for example, a benzothiazolium salt, nitroimidazoles, nitrobenzimidazoles, chlorobenzimidazoles, bromobenzimidazoles , mercaptothiazoles, mercaptobenzothiazoles, mercaptobenzimidazoles, mercaptothiadiazoles, aminotriazoles, benzotriazoles, nitrobenzotriazoles, and mercaptotetrazoles (in particular, 1-phenyl-5-mercaptoterazole); mercaptopyrimidines; mercaptotriadines; thioketo compounds, for example, such as oxazolinethions; azaindenes, for example, triazaindenes, tetrazaindenes [in particular, 4-hydroxy substituted (1,3,3a,7)tetrazaindenes], and pentaazaindenes; benzenethiosulfonic acid, benzenesulfinic acid, and benzenesulfonic acid amide.

The light-sensitive material of the present invention may contain one or more kinds of a surface active agent for various purposes such as a coating aid, anti-static agent, improvement in sliding properties, emulsification-dispersion, anti-adhesion, and improvement in photographic properties (for example, development acceleration, harder gradation and sensitization).

In the light-sensitive material prepared according to the present invention, water soluble dyes may be used in combination with the compound represented by formula (I) in a hydrophilic colloid layer as a filter dye or for various purposes such as anti-irradiation, anti-halation and otherwise. Preferably used are an oxonol dye, a hemioxonol dye, a styryl dye, a merocyanine dye, an anthraquinone dye, and an azo dye. In addition, also useful are a cyanine dye, an azomethine dye, a triarylmethane dye and a phthalocyanine dye. It is also possible to add an oil-soluble dye emulsified by an oil-in-water dispersion method to a hydrophilic colloid layer of the light-sensitive material of the present invention.

The present invention can be applied to a multilayer, multicolor light-sensitive material having at least two different spectral sensitivities. The multilayer color photographic light-sensitive material usually has at least one each of a red-sensitive emulsion layer, a green-sensitive emulsion layer, and a blue-sensitive emulsion layer provided on a support. An arrangement order of these layers can be appropriately selected depending on the intended application. A preferred layer arrangement is the order of a red-sensitive layer, a green-sensitive layer and a blue-sensitive layer; a blue-sensitive layer, a green-sensitive layer and a red-sensitive layer; or a blue-sensitive layer, a red-sensitive layer and a green-sensitive layer, wherein the first-named layer is provided closest to the support. Furthermore, a unit emulsion layer comprising two or more emulsion layers having the same color sensitivity but different photographic speeds may be used to improve the final sensitivity thereof, or the unit emulsion layer may have a three-layer construction to improve graininess. A non-light-sensitive layer may be present between two or more emulsion layers each having the same color sensitivity. The layer structure may be such that an emulsion layer having a different color sensitivity is interposed between emulsion layers each having the same color sensitivity. A reflection layer containing fine silver halide grains may be provided below a high sensitivity layer, particularly a high sensitivity blue-sensitive layer to increase sensitivity.

In general, a cyan-forming coupler is incorporated into a red-sensitive layer, a magenta-forming coupler into a green-sensitive layer and a yellow-forming coupler into a blue-sensitive layer, respectively, and it is also possible to have a different combination under some circumstances. For example, an infrared-sensitive layer may be combined for a pseudo color photograph exposed by a scanning infrared semiconductor exposure.

In the photographic light-sensitive material of the present invention, the photographic emulsion layers and other hydrophilic colloid layers are provided on a flexible support such as a plastic film, paper and cloth, or on rigid support such as glass, ceramics and metal, each of which is typically used for a photographic light-sensitive material. Useful flexible supports include a film made of a semi-synthetic or synthetic polymer such as cellulose nitrate, cellulose acetate, cellulose acetate butyrate, polystyrene, polyvinyl chloride, polyethylene terephthalate, and polycarbonate, and paper coated or laminated with a baryta layer or an $\alpha$-olefin polymer (for example, polyethylene, polypropylene, and a ethylene/butene copolymer). The support may be colored with a dye and a pigment. It may be black-colored for the purpose of light shielding.

In the case of a silver halide photographic light-sensitive material for photographic plate making, which is a preferred embodiment of the present invention, polyethylene terephthalate is particularly preferred as a support. The thickness thereof is not specifically limited, and is advantageously in the range of 12 to 500 $\mu$m, preferably 40 to 200 $\mu$m for easiness of handling, etc. Particularly preferred is biaxially stretched and crystallized polyethylene terephthalate for providing stability and strength. Further preferred is a support having on the both sides thereof a moisture barrier layer comprising a vinylidene chloride copolymer.

An appropriate thickness of the vinylidene chloride copolymer layer is preferred in order to control the stretching of the support due to water absorption during development processing. However, a vinylidene chloride copolymer layer that is too thick has poor adhesion with a silver halide emulsion layer. Accordingly, the thickness thereof is from 0.3 μm to 5 μm, preferably from 0.5 μm to 2.0 μm.

In coating a photographic emulsion layer and other hydrophilic colloid layers, various known methods can be used such as a dip-coating method, a roller coating method, a curtain coating method, and an extrusion coating method. If necessary, the multilayers may be coated simultaneously according to the methods described in U.S. Pat. Nos. 2,681,294, 2,761,791, 3,526,528, and 3,508,947.

The present invention can be applied to various color and black/white light-sensitive materials. Representative examples include a color negative film for a general purpose or a movie, a color reversal film for a slide or television, a color paper, a color positive film, a color diffusion-transfer type light-sensitive material, and a heat development type color light-sensitive material. Furthermore, the present invention can be applied to a direct positive color light-sensitive material as described in JP-A-63-159847, in which a non-pre-fogged internal latent image type silver halide emulsion is used. The three color couplers mixture described in *Research Disclosure* No. 17123 (July 1978) and the black color-developing couplers described in U.S. Pat. No. 4,126,461 and British Patent 2,102,136 can be utilized in the present invention, as well as to a black-and-white light-sensitive material such as an X-ray film. The present invention can be applied as well to a film for plate making, such as a lith film and a scanner film, an X-ray film for indirect and direct medical services or an industrial use, a negative black-and-white film for photographing, a black-and-white photographic paper, a micro film for COM and general use, and a printout type light-sensitive material.

Various exposing means can be applied to the light-sensitive material of the present invention. An appropriate light source radiating a radiant ray corresponding to a sensitivity wavelength of the light-sensitive material can be used as a light source for illumination or writing. Useful light sources include natural light (sun light), an incandescent lamp, a halogen atom-charged lamp, a mercury lamp, a fluorescent lamp, and a flash light source such as an electric flash and a metal-burning valve. There can also be used as a light source for recording, a gaslaser, a dye laser, a light-emitting diode, and a plasma light source, which emit light in a wavelength ranging from ultraviolet to infrared. Further, there can also be used a fluorescent display from which light is emitted with a phospher activated by an electron-ray and an X-ray, and an exposure means in which a linear or planewise light source is combined with a micro shutter array utilizing a liquid crystal (LC) and lanthanum-doped lead titanzirconate. The spectral distribution for exposure can be adjusted with a color filter as needed.

The imagewise exposed light-sensitive photographic material of the present invention may be processed by any of known methods and processing solutions described in, for example, *Research Disclosure,* No. 176, pp. 28 to 30 (RD-17643). The photographic processing may be either of a photographic processing in which a silver image is formed (a black-and-white photographic processing) and a photographic processing in which a color image is formed (a color photographic processing), as needed. The processing temperature is selected from the range of 18° to 50° C.

A developing solution for use in black-and-white photographic processing can contain known black-and-white developing agents. There can be used alone or in combination as the developing agent, dihydroxybenzenes (for example, hydroquinone), 3-pyrazolidones (for example, 1-phenyl-3-pyrazolidone), and aminophenols (for example, N-methyl-p-aminophenol). In addition thereto, the developing solution generally contains a known preservative, alkali agent, pH buffer agent, and antifoggant, and further, as needed, the developing solution may contain a dissolution aid, a toning agent, a developing accelerator (for example, quaternary salts, hydrazine and benzylalcohol), a surface active agent, a defoaming agent, a water softening agent, a hardener (for example, glutaric aldehyde), and a tackifier.

Any of known development processing methods in which a positive type silver image is formed by a reversal development can be used for the black-and-white reversal photographic processing of the light-sensitive material of the present invention. Known compounds can be used for the processing solutions. A processing temperature is selected from the range of 18° to 65° C. It may be lower than 18° C. or exceed 65° C.

The reversal development processing usually consists of the following steps:

First development—washing with water—bleaching—washing with water—overall exposure—second development—fixing—washing with water—drying.

The developing solution for use in black-and-white photographic processing of the first development can contain known developing agents. There can be used alone or in combination as the developing agent, dihydroxybenzenes (for example, hydroquinone), 3-pyrazolidones (for example, 1-phenyl-3pyrazolidone), aminophenols (for example, N-methyl-p-aminophenol), 1-phenyl-3-pyrazolines, ascorbic acid, and the heterocyclic compounds described in U.S. Pat. No. 4,067,872, which is prepared by condensing a 1,2,3,4-tetrahydroquinoline ring and an indolene ring. Particularly, the pyrazolidones and/or aminophenols are used preferably in combination with dihydroxybenzenes. In addition thereto, the developing solution may generally contain a known preservative, an alkali agent, a pH buffer agent, and an anti-foggant, and further as needed, a dissolution aid, a toning agent, a developing accelerator, a surface active agent, a defoaming agent, a water softening agent, a hardener, and a tackifier. The light-sensitive material of the present invention is usually processed with a processing solution containing sulfite ion in an amount of about 0.15 mole/liter as a preservative.

The pH of the first developing solution is preferably 8.5 to 11, particularly preferably 9.5 to 10.5.

A silver halide solvent such as NaSCN is added in an amount of 0.5 to 6 g/liter to the first developing solution.

A conventional black-and-white development processing solution can be used as the second developing solution. Namely, the composition of the second developing solution is such that the silver halide solvent from the first developing solution is removed from the photographic material. The pH of the second developing solution is preferably 9 to 11, particularly preferably 9.5 to 10.5.

A bleaching agent such as potassium bichromate and cerium sulfate is used for the bleaching solution.

Thiosulfates and thiocyanates are preferably used for the fixing solution, and as needed, water soluble aluminium salts may be contained therein.

A specific procedure of development processing may also be used, in which a light-sensitive material containing a developing agent, for example, in an emulsion layer is processed in an alkaline solution to carry out the development. A hydrophobic developing agent for carrying out this technique can be incorporated into an emulsion layer by the various methods described in Research Disclosure No. 169 (RD-16928), U.S. Pat. No. 2,739,890, British Patent 813,253, and German Patent 1,547,763.

The fixing solution can be of a generally known composition. Useful fixing agents include organic sulfur compounds having a fixing effect, as well as thiosulfates and thiocyanates. The fixing solution may contain a water soluble aluminium salt as a hardener.

The color developing solution used for color development processing of the light-sensitive material of the present invention is preferably an alkaline aqueous solution containing an aromatic primary amine type color developing agent as a primary component. An aminophenol compound is also useful as the color developing agent, but a p-phenylenediamine compound is preferably used. Examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidethylaniline, 3-methyl-4-amino-N-ethyl-N-β-methoxyethylaminiline, and the sulfates, chlorinates and p-toluenesulfonates thereof. The salts of these diamines rather than the free compounds are preferably used because the salts are generally more stable than the free compounds.

In general, the color developing solution contains a pH buffer agent such as a sulfate, a borate and a phosphate of alkali metals, and a development inhibitor or an anti-foggant such as bromide, iodide, a benzimidazole, a benzothiazole, and a mercapto compound. There may be added to the color developing solution as needed, a preservative such as a hydroxylamine, a dialkylhydroxylamine, a hydrazine, triethanolamine, triethylenediamine, and a sulfite, an organic solvent such as triethanolamine and diethylene glycol, a development accelerator such as benzyl alcohol, polyethylene glycol, a quaternary ammonium salt, and an amine, a dye-forming coupler, a competitive coupler, a nucleating agent such as sodium boron hydride, an auxiliary developing agent such as 1-phenyl-3-pyrazolidone, a tackifier, various chelating agents represented by amino polycarboxylic acid, amino polyphosphonic acid, alkylphosphonic acid, and phosphonocarboxylic acid, and an anti-oxidation agent as described in German Patent Application (OLS) 2,622,950.

In the development processing of a reversal color light-sensitive material, a color development is usually carried out after a black-and-white development. There can be used alone or in combination for the black-and-white development known black-and-white developing agents such as dihydroxybenzenes including hydroquinone, 3-pyrazolidones including 1-phenyl-3-pyrazolidone, and aminophenols including N-methyl-p-aminophenol.

Not only the color developing solution, but also generally known photographic developing methods may be applied to the light-sensitive material of the present invention. There are available as a developing agent for the developing solution, a dihydroxybenzene type developing agent, a 1-phenyl-3-pyrazolidone type developing agent, and a p-aminophenol type developing agent. These developing agents can be used alone or in combination (for example, 1-phenyl-3-pyrazolidones with dihydroxybenzenes or p-aminophenols with dihydroxybenzenes). Also, the light-sensitive material of the present invention may be processed by an infections type developing solution using a sulfurous acid ion buffer such as carbonyl bisulfite and hydroquinone.

Examples of the above noted dihydroxybenzene type developing agent include, for example, hydroquinone, chlorohydroquinone, bromohydroquinone, isopropylhydroquinone, toluhydroquinone, methylhydroquinone, 2,3-dichlorohydroquinone, and 2,5-dimethylhydroquinone. There are available as the 1-phenyl-3-pyrazolidone type developing agent, 1-phenyl-3-pyrazolidone, 4,4-dimethyl-1-phenyl-3-pyrazolidone, 4-hydroxymethyl-4'-methyl-1-phenyl-3-pyrazolidone, and 4,4-dihydroxymethyl-1-phenyl-3-pyrazolidone. There are used as the p-aminophenol type developing agent, p-aminophenol and N-methyl-p-aminophenol. There are added to the developing solution as a preservative compounds providing a dissociated sulfite ion, for example, sodium sulfite, potassium sulfite, potassium meta-hydrosulfite, and sodium hydrosulfite. In the case of an infections type developing solution, formaldehyde sodium hydrosulfite may be used which provides only a small amount of dissociated sulfite ion. Useful alkali agents for the developing solution for use in the present invention include potassium hydroxide, sodium hydroxide, potassium carbonate, sodium carbonate, sodium acetate, potassium triphosphate, diethanolamine, and triethanolamine. The pH of the developing solution is usually set at 8.5 or more, preferably 9.5 or more.

The developing solution for use in the present invention may contain organic compounds known as antifoggants or development inhibitors. Examples thereof are azoles, for example, benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (in particular, 1-phenyl-5-mercaptotetrazole); mercaptopyrimidines; mercaptotriadines; thioketo compounds, for example, oxazolinethions; azaindenes, for example, triazaindenes, tetrazaindenes [in particular, 4-hydroxy substituted (1,3,3a,7) tetrazaindenes], and pentazaindenes; and benzenethiosulfonic acid, benzenesulfinic acid, benzenesulfonic acid amide, and sodium 2-mercatobenzimidazole-5-sulfonate.

A polyalkylene oxide may be incorporated as a development inhibitor into the developing solution for use in the present invention. For example, polyethylene oxide having a molecular weight of 1000 to 10000 can be added to the developing solution in an amount of from 0.1 to 10 g/liter.

There are preferably added as a water softening agent to the developing solution, nitriloacetic acid, ethylenediaminetetracetic acid, triethylenetetramine, and diethylenetetraminepentacetic acid.

There can be used for the developing solution for use in the present invention the compounds described in JP-A-62-24347 as an anti-silver stain agent, and the compounds described in JP-A-62-212651 as an anti-mottling agent.

There can be used for the developing solution of use in the present invention, boric acid as a buffer agent, the sugars described in JP-A-60-93433 (for example, sucrose), oximes (for example, acetoxime), phenols (for example, 5-sulfosalicylic acid), and triphosphoric acid salts (for example, a sodium salt and a potassium salt).

Various compounds may be used as a development accelerator for use in the present invention. The development accelerator may be added either to a light-sensitive material or a processing solution. Preferred development accelerators include an amine compound, an imidazole compound, an imidazoline compound, a phosphonium compound, a sulfonium compound, a hydrazine compound, a thioether compound, a thione compound, certain kinds of a mercapto compound, a mesoion compound, and a thiocyanic acid salt.

The development accelerators are necessary for rapid processing. The development accelerators are added preferably to a color developing solution, but can also be added to a light-sensitive material depending on the type of accelerator used, or the structural position on a support of a light-sensitive layer to contain the a development acceleration. Also, it is possible to add a development accelerator both to the developing solution and the light-sensitive material. Furthermore, the development accelerator may be added to a pre-bath for the color developing bath.

Amino compounds useful as the development accelerator include both inorganic amines and organic amines such as hydroxylamine. The organic amine can include an aliphatic amine, aromatic amine, cyclic amine, aliphatic aromatic mixed amine, and heterocyclic amine. Primary, secondary and tertiary amines and quaternary ammonium compounds are all useful.

The photographic emulsion layer is usually subjected to a bleaching treatment after color developing. The bleaching treatment may be carried out at the same time as a fixing treatment, or may be carried out independently. A processing method in which a bleach-fixing treatment is carried out may be employed after the bleaching treatment in order to accelerate the processing. Useful bleaching agents include, for example, the compounds of polyvalent metals such as iron (III), cobalt (III), chromium (IV) and copper (II), peracids, quinones, and nitrones. Representative bleaching agents are ferricyanide compounds; bichromates; organic complex salts of iron (III) or cobalt (III), for example, the complex salts of aminopolycarboxylic acids such as ethylenediaminetetracetic acid, diethylenetriaminepentacetic acid, nitrilotriacetic acid, and 1,3-diamino-2-propanol-tetracetic acid, and the complex salts of the organic acids such as citric acid, tartaric acid and malic acid; persulfates; manganates; and nitrosophenols. Among them, preferred for rapid processing and environmental factors are iron (III) ethylenediaminetetracetate, iron (III) diethylenetriaminepentacetate, and persulfate. Furthermore, iron (III) ethylenediaminetetracetate is particularly useful either for an independent bleaching solution or an integrated bleach-fixing bath.

Bleaching accelerators can be used for a bleaching bath, a bleach-fixing bath and the pre-baths thereof as needed. Useful examples of bleaching accelerators are described in the following publications: the compounds having a mercapto group or a disulfide group as described in U.S. Pat. No. 3,893,858, German Patents 1,290,812 and 2,059,988, JP-A-53-32736, JP-A-53-57831, JP-A-53-37418, JP-A-53-65732, JP-A-53-72623, JP-A-53-95630, JP-A-53-95631, JP-A-53-104232, JP-A-53-124424, JP-A-53-141623, and JP-A-53-28426, and *Research Disclosure* No. 17129 (July 1978); the thiazolidine derivatives as described in JP-A-50-140129; thiourea derivatives as described in JP-B-45-8506, JP-A-52-20832 and JP-A-53-32735, and U.S. Pat. No. 3,706,561; iodides as described in German Patent 1,127,715 and JP-A-58-16235; polyethylene oxides as described in German Patents 966,410 and 2,748,430; the polyamine compounds as described in JP-B-45-8836; and the compounds described in JP-A-49-42434, JP-A-49-59644, JP-A-53-94927, JP-A-54-35727, JP-A-55-26506, and JP-A-58-163940. Iodine ion and bromide ion can also be used. Among them, the compounds having a mercapto group or a disulfide group are preferred for providing a larger bleaching acceleration effect. Particularly preferred are the compounds described in U.S. Pat. No. 3,893,858, German Patent 1,290,812, and JP-A-53-95630. Furthermore, the compounds described in U.S. Pat. No. 4,552,834 are also preferred. The bleaching accelerators are particularly useful when a color light-sensitive material for photographing is bleached and fixed.

Useful fixing agents include, thiosulfates, thiocyanates, thioether compounds, thioureas, and a large quantity of iodide. Of these, thiosulfates are generally used. Sulfites, bisulfites and carbonyl bisulfite adducts are preferred as a preservative for a bleach-fixing solution and a fixing solution.

After a bleach-fixing treatment or a fixing treatment, a washing treatment and a stabilizing treatment are usually carried out. In the washing step and stabilizing step, various known compounds may be used for prevention of precipitation and water conservation. If necessary, there can be added to the washing or stabilizing solutions for the prevention of precipitation, for example, a water softening agent such as inorganic phosphoric acid, aminopolycarbonic acid, organic aminopolyphosphonic acid, and organic phosphoric acid; fungicides and anti-mold agents which can prevent the generation of various bacterium, algae and molds; metal salts represented by a magnesium salt, an aluminum salt and a bismuth salt; a surface active agent for reducing the drying load and promoting even drying; and various hardeners. Also, there may be added to the washing or stabilizing solutions the compounds described in *Photographic Science and Engineering,* Vol. 6, pp. 344 to 359 (1965), written by L. E. West. Particularly, a chelating agent and an anti-mold agent are advantageously used.

The washing step is generally carried out by countercurrent washing in two or more baths for water conservation. Further, the washing step may be replaced by a multi-stage countercurrent stabilizing step as described in JP-A-57-8543. In this step, 2 to 9 countercurrent baths are employed. In addition to the above additives, various compounds are added to the stabilizing bath for the purpose of stabilizing an image. Representative examples thereof include, for example, various buffer agents for adjusting layer pH (for example, pH 3 to 9) (there can be used in combination, for example, borates, metaborates, borax, phosphates, carbonates, potassium hydroxide, sodium hydroxide, aqueous ammonia, monocarboxylic acid, dicarboxylic acid, and polycarboxylic acid), and aldehydes such as formalin. Besides, according to necessity, there may be used a chelating agent (inorganic phosphoric acid, aminopolycarboxylic acid, organic phosphoric acid, organic phosphonic acid, aminopolyphosphonic acid, and phosphonocarboxylic acid), a fungicide (benzoisothiazolinone, isothiazolone, 4-thiazolinebenzimidazole, halogenated phenol, sulfanylamide, and benzotriazole), a surface active agent, a fluorescent whitening agent, and a hardener. Two or more types of compounds added for the same or different purposes may be used in combination.

Furthermore, preferably added as a layer pH adjusting agent to the washing or stabilizing solutions after processing are various ammonium salts such as ammonium chloride, ammonium nitrate, ammonium sulfate, ammonium phosphate, ammonium sulfite, and ammonium thiosulfate.

In a light-sensitive material for photographing, a conventional steps after fixing (washing and stabilizing) can be replaced by the above described stabilizing step and washing step (water saving countercurrent processing). In this case, if a magenta coupler is diequivalent, any formalin contained in the stabilizing bath may be removed.

In the present invention, washing and stabilizing time varies depending on the type of light-sensitive material and the processing conditions. It is usually 20 seconds to 10 minutes, preferably 20 seconds to 5 minutes.

The silver halide color light-sensitive material of the present invention may contain therein a color developing agent for simplification and acceleration of processing. Various precursors of the color developing agents are preferably incorporated into the light-sensitive material. Useful color development agent precursors include, for example, various salt type precursors as described in JP-A-56-6235, JP-A-56-16133, JP-A-56-59232, JP-A-56-67842, JP-A-56-83734, JP-A-56-83735, JP-A-56-83736, JP-A-56-89735, JP-A-56-81837, JP-A-56-54430, JP-A-56-106241, JP-A-56-107236, JP-A-57-97531, and JP-A-57-83565, as well as the indoaniline compounds described in U.S. Pat. No. 3,342,597, the Shiff base type compounds described in U.S. Pat. No. 3,342,597 and *Research Disclosure* 14850 and 15159, the aldol compounds described in *Research Disclosure* 13924, the metal salt complexes described in U.S. Pat. No. 3,719,492, and the urethane compounds described in JP-A-53-135628.

The silver halide color light-sensitive material of the present invention may contain various kinds of 1-phenyl-3-pyrazolidones for accelerating color development as needed. Typical compounds are described in JP-A-56-64339, JP-A-57-144547, JP-A-57-211147, JP-A-58-50532, JP-A-58-50536, JP-A-58-50533, JP-A-58-50534, JP-A-58-50535, and JP-A-58-115438.

In the present invention, various processing solutions are used at 10° to 50° C. A temperature of 33° to 38° C. is a standard processing temperature range. However, the temperature can be set higher to accelerate the processing and to shorten a processing time, or on the contrary, the temperature can be set lower to achieve an increase in an image quality and improvement in the stability of the processing solution. Furthermore, in order to save on the amount of silver contained in the light-sensitive material, cobalt intensification or a hydrogen peroxide intensification processing may be used, as described in German Patent 2,226,770 and U.S. Pat. No. 3,674,499.

The various processing baths may be provided with a heater, a temperature sensor, a liquid level sensor, a circulating pump, a filter, a floating lid and a squeezer as needed.

In continuous processing, variation in the composition of the processing solutions can be prevented by using replenishing solutions for the respective processing solutions, to thereby achieve uniform photographic properties. The replenishing amounts can be reduced to one-half or less of a standard replenishing amount to reduce operating costs.

Where the light-sensitive material is a color paper, it is subjected to conventional bleach-fixing treatment, and where it is a color photographic material for photographing, it is subjected to a bleach-fixing treatment as needed.

In the present invention, the development processing time is defined as the difference in time from when the edge of the light-sensitive material is dipped into the developing solution until the light-sensitive material is removed from a final drying zone.

The present invention is explained below in greater detail with reference to following Examples, but the present invention is not to be construed as being limited thereto.

EXAMPLE 1

The following layers were coated on a 180 μm thick polyethylene terephthalate support subbed with gelatin:

Layer (1) containing gelatin at a coverage of 2.0 g/m$^2$ and 1,3-bisvinylsulfonyl-2-propanol, and Layer (2) containing 1.0 g/m$^2$ of gelatin, 0.12 mmol/m$^2$ of the compound shown in Table 1, 0.17 mmol/m$^2$ of the following betain type surface active agent a and 1,3-vinylsulfonyl-2-propanol.

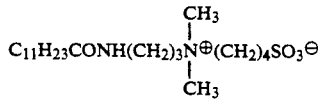

The compounds shown in Table 1, each of which was dissolved in a small amount of dimethylformamide, were added while stirring before a hardener was added to the coating solution for Layer (2).

The absorption spectra were measured with a spectral photometer Hitachi U-3210, and the maximum absorption wavelength, the absorbance at the maximum absorption wavelength, and the half value width are shown together in Table 1.

A comparative sample was prepared in the same manner as described above, except that Layer (2) was replaced by a layer having a coverage of 1.0 g/m$^2$ of gelatin, 0.12 mmol/m$^2$ of the following dye A dispersed in a solid form according to the method described in the examples of published International Patent Application (WO) 88/04794, and 1,3-bisvinylsulfonyl-2-propanol.

Dye A

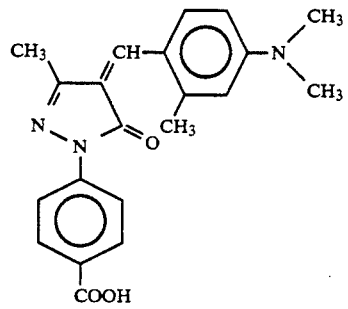

A second comparative sample was prepared in the same manner as the above described first comparative sample, except that the dye A was replaced by an equimolar amount of the following dye B.

The dyes were added by dissolving in water.

TABLE 1

Dye B

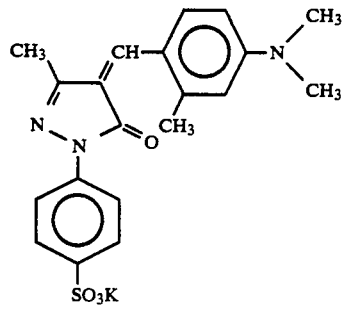

| Sample No. | Compound No. | Max. absorption wavelenth (nm) | Absorbance | Half value width (nm) | Fixing rate (%) |
|---|---|---|---|---|---|
| 1-1 (Comp.) | A | 505 | 0.181 | 204 | 99 |
| 1-2 (Comp.) | B | 492 | 0.625 | 73 | 0 |
| 1-3 (Inv.) | 1 | 486 | 0.412 | 91 | 98 |
| 1-4 (Inv.) | 2 | 352 | 0.482 | 79 | 94 |
| 1-5 (Inv.) | 3 | 476 | 0.382 | 88 | 95 |
| 1-6 (Inv.) | 7 | 485 | 0.644 | 76 | 99 |
| 1-7 (Inv.) | 13 | 519 | 0.420 | 96 | 97 |

As seen from the results summarized in Table 1, the compounds of the present invention generally have smaller half value widths and sharp absorption characteristics, and clearly have larger absorbances as compared to the dyes dispersed in a solid form.

The above noted results clearly indicate that the dyes of the present invention provide excellent performance as an antihalation dye for a light-sensitive material subjected to an exposure with a characteristic wavelength, while also providing excellent performance as a filter dye.

EXAMPLE 2

The samples prepared in Example 1 were dipped in a phosphoric acid buffer solution of pH 5 for five minutes and then slightly washed, followed by drying. The fixing ratio obtained by dividing the absorbance after dipping treatment with that before the dipping treatment is shown in Table 1 above.

As seen from the results shown in Table 1, the dyes of the present invention are strongly fixed compared with the water soluble dye B. Furthermore, the dyes of the present invention can be fixed in a specific layer.

Further, the samples prepared in Example 1 were subjected to development with an automatic developing machine FG-310PTS manufactured by Fuji Photo Film Co., Ltd. employing a developing time of 20 seconds and 38° C., and then subjected to a decoloration test. The processed and dried samples were subjected to an aging test for three days at 50° C. and 65% RH, and then, the absorbances were measured. The results are shown as the ratio of residual color to the absorbance of the light-sensitive material before processing. LD-835 manufactured by Fuji Photo Film Co., Ltd. was used as a developing solution and LF-308 was used as a fixing solution.

The results showed that the all samples had a color residual ratio of essentially zero. Thus, the dyes of the present invention exhibit an excellent decoloration property.

EXAMPLE 3

First light-sensitive emulsion layer

Preparation of a light-sensitive emulsion A

An aqueous silver nitrate solution of 0.37 M and a halide solution containing $(NH_4)RhCl_6$ of $1\times10^{-7}$ mole per mole of silver, $K_3IrCl_6$ of $5\times10^{-7}$ mole per mole of silver, potassium bromide of 0.11 M and sodium chloride of 0.27 M were added while stirring to an aqueous gelatin solution containing sodium chloride and 1,3-dimethyl-2-imidazolidinethione by a double jet method at 45° C. for 12 minutes, to thereby obtain for nucleus formation silver chlorobromide grains having an average grain size of 0.20 μm and a silver chloride content of 70 mol %. Subsequently, an aqueous silver nitrate solution of 0.63 M and an aqueous halide solution containing potassium bromide of 0.19 M and sodium chloride of 0.47 M were similarly added by the double jet method over a period of 20 minutes. Thereafter, a KI solution of $1\times10^{-3}$ mole per mole of silver was added to carry out halogen conversion, and the emulsion was subjected to washing treatment by a conventional flocculation method. Then, 40 g of gelatin were added, and the pH and pAg were adjusted to 6.5 and 7.5, respectively. Further, sodium thiosulfate of 5 mg, chloroauric acid of 8 mg and sodium benzenethiosulfonate of 7 mg each per mole of silver were added, and the emulsion was heated at 60° C. for 45 minutes to carry out chemical sensitization, followed by adding 1,3,3a,7-tetrazaindene of 150 mg as a stabilizer, proxel and phenoxyethanol. The grains thus obtained were silver chlorobromide cubic grains having an average grain size of 0.28 μm and a silver chloride content of 70 mol % (variation coefficient: 9%).

Coating of the first light-sensitive emulsion layer

To these divided emulsions were added as a sensitizing dye 5-[3-(4-sulfobutyl)-5-chloro-2-oxazolidilidene]-1-hydroxyethyl-3-(2-pyridyl)-2-thiohydantoin of $1\times10^{-3}$ mole per mol of silver, 1-phenyl-5-mercaptotetrazole of $2\times10^{-4}$ mole per mole of silver, a short wavelength cyanine dye of the compound (a) in an amount of $5\times10^{-4}$ mole per mole of silver having the structural formula given below, a polymer of the compound (b) (200 mg/m$^2$), hydroquinone (50 mg/ m$^2$), a dispersion of polyethylacrylate (200 mg/m$^2$), 1,3-bisvinylsulfonyl-2-propanol as a hardener (200 mg/m$^2$), and the following hydrazine compound (c). The coating solution thus prepared was applied such that the coated amounts of silver and gelatin were 3.6 g/m$^2$ and 2.0 g/m$^2$, respectively.

Compound (a)

-continued

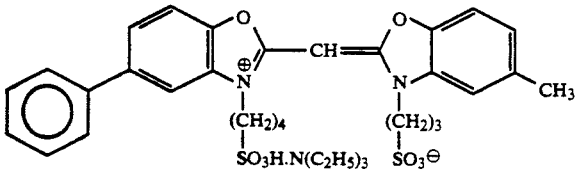

Compound (b)

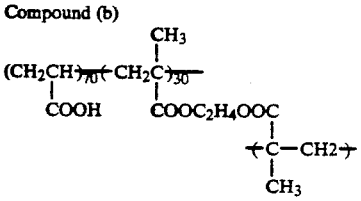

Hydrazine compound (c) $2.8 \times 10^{-5}$ mol/m$^2$

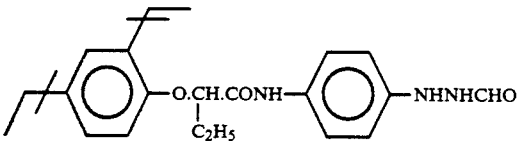

| Coating of intermediate layer | |
|---|---|
| Gelatin | 1.0 g/m$^2$ |
| 1,3-Bis-vinylsulfonyl-2-propanol | 4.0 2t % based on a gelatin amount |

Second light-sensitive emulsion layer

Preparation of a light-sensitive emulsion B

An aqueous silver nitrate solution of 1.0 M and a halide solution containing $(NH_4)_3RhCl_6$ of $3\times10^{-7}$ mole per mole of silver, potassium bromide of 0.3 M and sodium chloride of 0.74 M were added while stirring to an aqueous gelatin solution containing sodium chloride and 1,3-dimethyl-2-imidazolidinethione by a double jet method at 45° C. for 30 minutes, to obtain silver chlorobromide grains having an average grain size of 0.28 μm and a silver chloride content of 70 mol %. Thereafter, the emulsion was subjected to a washing treatment by a conventional flocculation method. Then, 40 g of gelatin were added, and the pH and pAg were adjusted to 6.5 and 7.5, respectively. Further, sodium thiosulfate of 5 mg and chloroauric acid of 8 mg each per mole of silver were added, and the emulsion was heated at 60° C. for 60 minutes to carry out chemical sensitization, followed by adding 1,3,3a,7-tetrazaindene of 150 mg as a stabilizer. The grains thus obtained were silver chlorobromide cubic grains having an average grain size of 0.28 μm and a silver chloride content of 70 mol % (variation coefficient: 10%).

Coating of the second light-sensitive emulsion layer

To the redispersed emulsion B were added 5-[3-(4-sulfobutyl)-5-chloro-2-oxazolidilidene]-1-hydroxyethyl-3-(2-pyridyl)-2-thiohydantoin of $1.0\times10^{-3}$ mole per mol of silver as a sensitizing dye and a KI solution of $1.0\times10^{-3}$ mole per mole of silver, and further added were 1-phenyl-5-mercaptotetrazole of $2\times10^{-4}$ mole per mole of silver, a dispersion of polyethylacrylate 50 mg/m$^2$, and 1,3-bis-vinylsulfonyl-2-propanol of 4.0 wt % based on the gelatin content. The coating solution thus prepared was applied such that the coated amounts of silver and gelatin were 0.4 g/m$^2$ and 0.5 g/m$^2$, respectively.

Coating of a protective layer

A protective layer was provided containing gelatin of 1.5 g/m$^2$, the compound (5) of the present invention of 0.1 g/m$^2$, and polymethyl methacrylate particles (average grain size: 2.5 μm) of 0.3 g/m$^2$ with the following surface active agents:

| | |
|---|---|
| 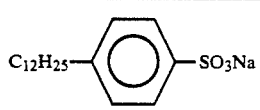 | 37 mg/m$^2$ |
| $CH_2COOC_6H_{13}$<br>\|<br>$CHCOOC_6H_{13}$<br>\|<br>$SO_3Na$ | 37 mg/m$^2$ |
| $C_8F_{17}SO_2NCH_2COOK$<br>\|<br>$C_3H_7$ | 2.5 mg/m$^2$ |

The compound of the present invention was dissolved in a minimum amount of dimethylformamide, and this solution was added to a gelatin solution for dispersion while stirring.

A back layer and back protective layer were coated and had the following compositions:

| Composition of the back layer: | |
|---|---|
| Gelatin | 3 g/m$^2$ |
| Latex polyethylacrylate | 2 g/m$^2$ |
| Surface active agent, sodium p-dodecylbenzenesulfonate | 40 mg/m$^2$ |
| Gelatin hardener | 110 mg/m$^2$ |

-continued

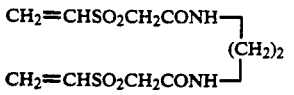

Dye, the mixture of the dyes (a), (b) and (c)

Dye (a) 50 mg/m²

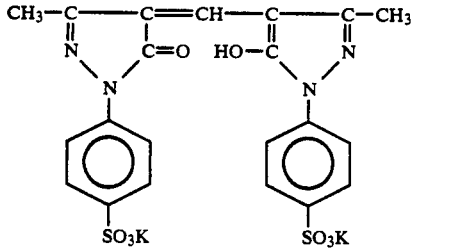

Dye (b) 100 mg/m²

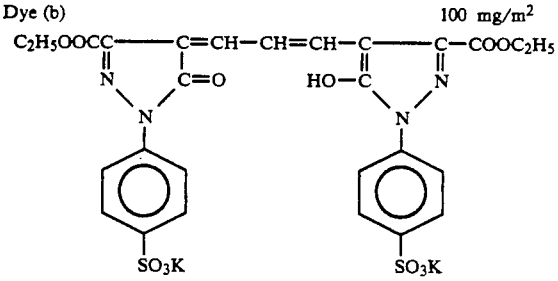

Dye (c) 50 mg/m²

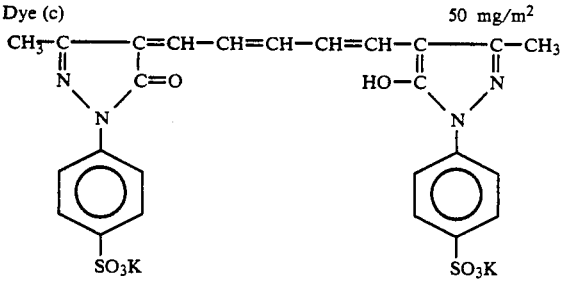

Composition of back protective layer:

| | |
|---|---|
| Gelatin | 0.8 g/m² |
| Polymethylmethacrylate fine particle (average grain size: 4.5 μm) | 30 mg/m² |
| Sodium dihexyl-α-sulfosuccinate | 15 mg/m² |
| Sodium dodecyulbenzenesulfonate | 15 mg/m² |
| Sodium acetate | 40 mg/m² |
| Fluorinated surface active agent $C_8F_{17}SO_2N(C_3H_7)CH_2COOK$ | 5 mg/m² |

There were simultaneously coated on a polyester film support (100 μm), the first light-sensitive layer as the lowest layer, the second light-sensitive layer containing a redox compound via an intermediate layer and provided thereon a protective layer, to thereby obtain Sample 3-1.

Coated Sample 3-2 was prepared in the same manner as Sample 3-1, except that the compound (5) was replaced by an equimolar amount of the compound (8).

Preparation of the comparative samples

Comparative Sample 3-3 was prepared in the same manner as Sample 3-1, except that the compound (5) was not added.

Comparative Sample 3-4 was prepared in the same manner as Sample 3-1, except that the compound (5) was replaced by the following water soluble UV absorber in an amount of 0.05 g/m².

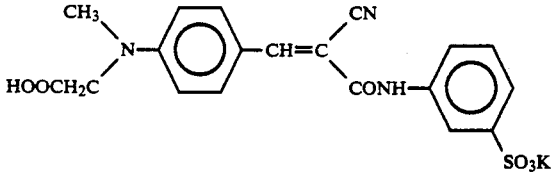

Evaluation of Performance (1) The above four samples were imagewise exposed via an optical wedge with a daylight printer P-607 manufactured by Dainippon Screen Co., Ltd. The exposed samples were subjected to a development with an automatic developing machine FG680A manufactured by Fuji Photo Film Co., Ltd. in the following developing solution at 34° C. for 30 seconds, and then to fixing by a conventional method, followed by washing, and drying. The UV optical densities of Samples 3-1, 3-2 and 3-4 in the highlight portions were as low as that of Sample 3-3, and the samples after processing were completely decolored.

| Developing solution | |
|---|---|
| Hydroquinone | 50.0 g |
| N-methyl-p-aminophenol | 0.3 |
| Sodium hydroxide | 18.0 |
| 5-Sulfosalicylic acid | 30.0 |
| Boric acid | 25.0 |
| Potassium sulfite | 24.0 |
| Disodium ethylenediaminetetracetate | 1.0 |
| Potassium bromide | 10.0 |
| 5-Methylbenzotriazole | 0.4 |
| 2-Mercaptobenzimidazole-5-sulfonic acid | 0.3 |
| Sodium 3-(5-mercaptotetrazole) benzenesulfonate | 0.2 |
| N-n-butyldiethanolamine | 15.0 |
| Sodium toluenesulfonate | 8.0 |
| Water was added to | 1 liter |
| pH was adjusted with potassium hydroxide to | 11.6 |

The sensitivity of Comparative Sample 3-4 was lowered by 0.4 in terms of a log E value and the sensitivities of Samples 3-1 and 3-2 of the present invention were lowered by 0.43. The sensitivities of Samples 3-1 and 3-2 and Comparative Sample 3-4 were practically useful.

(2) Test of safety to a safelight

The above four samples were subjected to a test of safe time under 400 lux of a safelight of a UV-cut fluorescent lamp FLR-40SW-DLX-NU-M manufactured by Toshiba Corp. Comparative Sample 3-4 and Samples 3-1 and 3-2 of the present invention provided a safe time of 20 minutes and 25 minutes, respectively, while Comparative Sample 3-3 provided a safe time of 10 minutes.

The results of the above tests (1) and (2) show that the compounds of the present invention effectively lower the sensitivity to a reasonable level, yet remarkably increase protection from a safelight.

(3) Test of tone variation

The above four samples were exposed via a flat net screen with the above printer, and then were subjected to development processing in the same manner as in test (1). The exposure time necessary to provide a halftone dot area in a ratio of 1:1 was determined in each sample and then, the Samples were exposed to two and four times the above determined exposure time to evaluate expansion of the halftone dot area. A larger increase in the halftone dot area indicates better tone variation. The results are shown in Table 2.

TABLE 2

| Sample No. | Two times exposure | Four times exposure |
|---|---|---|
| 3-3 (Comp.) | +5% | +9% |
| 3-4 (Comp.) | +2% | +4% |
| 3-1 (Inv.) | +5% | +9% |
| 3-2 (Inv.) | +5% | +9% |

As seen from the results shown in Table 2, Samples 3-1 and 3-2 of the present invention have a high tone variation, while Comparative Sample 3-4 notably has low tone variation. The poor results of Comparative Sample 3-4 are due to uniform diffusion of the dye from the layer initially containing the dye to a light-sensitive emulsion layer. Particularly, the dye of Comparative Sample 3-4 is water soluble and dispersible. Thus, even when the exposure time is increased, the halftone dot area is prevented from expanding by the anti-irradiation effect of the dye. On the other hand, the compounds (5) and (8) of the present invention provide high tone variations since these dyes are fixed to the layer to which they are added.

EXAMPLE 4

Emulsion B

An aqueous silver nitrate solution of 2.9 M and an aqueous halide solution containing sodium chloride of 3.0 M and ammonium hexachlororhodium (III) acid of $5.3\times10^{-5}$ M were added while stirring to an aqueous gelatin solution of pH 2.0 containing sodium chloride at 38° C. for 4 minutes at a constant potential of 100 mV to form grain nuclei. After one minute, an aqueous silver nitrate solution of 2.9 M and an aqueous halide solution containing sodium chloride of 3.0 M were added at one-half the rate during the nuclei formation at 38° C. for 8 minutes at a constant potential of 100 mV. Thereafter, the emulsion was subjected to a washing treatment according to a conventional flocculation method. Then, gelatin was added, and the pH and pAg were adjusted to 5.7 and 7.4, respectively. Further, 5,6-trimethylene-7-hydroxy-s-triazolo(2,3-a)pyrimidine of 0.05 mole per mole of silver was added as a stabilizer. The grains thus obtained were silver chloride cubic grains containing Rh of $8.0\times10^{-6}$ mole per mole of silver and having an average grain size of 0.13 μm (variation coefficient: 11%).

Emulsion C

An aqueous silver nitrate solution of 2.9 M and an aqueous halide solution containing sodium chloride of 2.6 M, potassium bromide of 0.4 M and ammonium hexachlororhodium (III) acid of $5.3\times10^{-5}$ M were added while stirring to an aqueous gelatin solution of pH 2.0 containing sodium chloride at 40° C. for 4 minutes at a constant potential of 85 mV to form grain nuclei. After one minute, an aqueous silver nitrate solution of 2.9 M and an aqueous halide solution containing sodium chloride of 2.6 M and potassium bromide of 0.4 M were added at one-half the rate during the nuclei formation at 40° C. for 8 minutes at a constant potential of 85 mV. Thereafter, the emulsion was subjected to a washing treatment according to a conventional flocculation method. Then, gelatin was added, and the pH and pAg were adjusted to 5.7 and 7.4, respectively. Further, 1,3,3a,7-tetrazaindene in an amount of $3.0\times10^{-3}$ mole per mole of silver was added as a stabilizer. The grains thus obtained were silver bromochloride cubic grains containing Rh in an amount of $8.0\times10^{-6}$ mole per mole of silver and having an average grain size of 0.16 μm (Br content: 15 mol %, variation coefficient: 12%).

To the emulsions B and C, 1-phenyl-5-mercaptotetrazole of 2.5 mg $m^2$ and a polyethyl acrylate latex (average particle size: 0.05 μm) of 770 mg/$m^2$ were added, and further, 2-bis(vinylsulfonylacetamide) ethane of 126 mg/$m^2$ was added as a hardener. The emulsions thus prepared were coated, respectively, on a polyester support, such that the coated amounts of silver and gelatin were 3.6 g/$m^2$ and 1.5 g/$m^2$, respectively.

A lower protective layer was coated thereon containing gelatin of 0.8 g/$m^2$, lipo acid of 8 mg/$m^2$, and a polyethyl acrylate latex (average particle size: 0.05 μm) of 230 mg/$m^2$. Further, an upper protective layer was coated thereon containing gelatin of 3.2 g/$m^2$ and the dyes of the invention or comparative dyes as indicated in Table 3. Simultaneously coated were a matting agent (silicon dioxide, an average particle size 3.5 μm) of 55 mg/$m^2$, methanol silica (average particle size: 0.02 μm) of 135 mg/$m^2$, sodium dodecylbenzenesulfonate of 25 mg/$m^2$ as a coating aid, sulfuric acid ester sodium salt of poly (polymerization degree: 5) oxyethylene nonylphenyl ether of 20 mg/$m^2$, and potassium N-perfluorooctanesulfonyl-N-propylglycine of 3 mg/$m^2$, to thereby prepare the samples.

The support used in this example had a back layer and back protective layer of the following compositions (swelling rate of back side: 110%):

| Composition of back layer | |
|---|---|
| Gelatin | 170 mg/$m^2$ |
| Sodium dodecylbenzenesulfonate | 32 mg/$m^2$ |
| Sodium dihexyl-α-sulfosuccinate | 35 mg/$m^2$ |
| $SnO_2$/Sb (9/1 ratio by weight, average particle size: 0.25 μm) | 318 mg/$m^2$ |
| **Composition of back protective layer** | |
| Gelatin | 2.7 g/$m^2$ |
| Silicon dioxide matting agent (average particle size: 3.5 μm) | 26 mg/$m^2$ |
| Sodium dihexyl-α-sulfosuccinate | 20 mg/$m^2$ |
| Sodium dodecylbenzenesulfonate | 67 mg/$m^2$ |
| $C_8F_{17}SO_2N(C_3H_7)-(CH_2CH_2O)_n-(CH_2)_4-SO_3Li$ | 5 mg/$m^2$ |
| Dye A | 190 mg/$m^2$ |
| Dye B | 32 mg/$m^2$ |

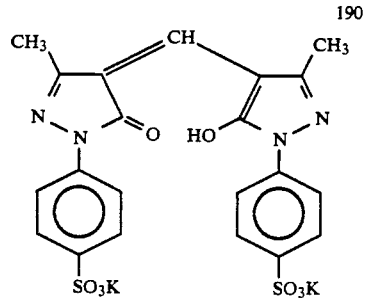

-continued

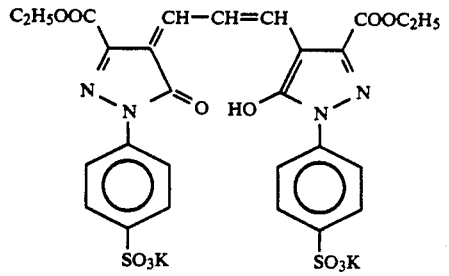

Dye C 59 mg/m²

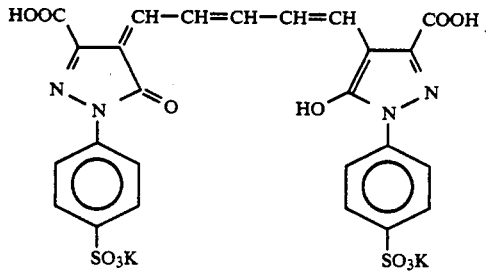

| | |
|---|---|
| Polyethyl acrylate latex (an average particle size: 0.05 μm) | 260 mg/m² |
| 1,3-Divinyl-sulfonyl-2-propanol | 149 mg/m² |

EVALUATION OF PHOTOGRAPHIC PROPERTIES

The samples thus obtained were imagewise exposed through an optical wedge with a Q printer (quartz) P-617D manufactured by Dainippon Screen Co., Ltd. The exposed Samples were developed at 38° C. for 20 seconds in a developing solution LD-835 manufactured by Fuji Photo Film Co., Ltd., followed by fixing, washing and drying using an automatic developing machine FG-800RA. The samples thus processed were evaluated as follows:

1) Relative sensitivity: defined as the reciprocal of an exposure providing a density of 1.5, and expressed as a value relative to that of Sample 1, which is set at 100.

2) γ: (3.0–0.3)/{[log (exposure giving a density of 3.0)-log (exposure giving a density of 0.3)}

Also, the drawn letter quality was evaluated, wherein a light-sensitive material, an original and a supporting base were superposed in the following order:

(a) transparent or translucent supporting base,
(b) line picture original (a black portion represents a line picture),
(c) transparent or translucent supporting base,
(d) halftone dot original, and
(e) light-sensitive material for dot to dot work.

The results are shown in Table 3.

TABLE 3

| Sample No. | Emulsion | Dye | Add. amount (mg/m²) | Relative sensitivity | γ | Drawn letter quality |
|---|---|---|---|---|---|---|
| 4-1 (Comp.) | B | D | 10 | 100 | 7.3 | 1.5 |
| 4-2 (Inv.) | B | 7 | 40 | 100 | 8.0 | 3.5 |
| 4-3 (Comp.) | C | D | 15 | 100 | 5.4 | 1.5 |
| 4-4 (Inv.) | C | 7 | 60 | 101 | 6.0 | 3.5 |

A drawn letter quality 5, which is of very good quality, means that a letter of 30 μm width is reproduced when a halftone dot area of 50% is reasonably exposed on a light-sensitive material for contact work with an original as shown in FIG. 1 of JP-A-62-235938, such that a halftone dot area of 50% is formed thereon. On the other hand, a drawn letter quality 1, which is of poor quality, means the that a letter of a 150 μm width or more can be reproduced. The grades of 4 to 2 are provided between 5 and 1. A grade of 3 or higher is practically useful.

None of the processed samples had residual color. As apparent from the results shown in Table 3, excellent drawn letter quality is obtained in accordance with the present invention without deterioration in sensitivity and gradation, and wherein good performance in contact work is obtained.

EXAMPLE 5

Preparation of Sample 5-1

Layers having the following compositions were provided on a 127 μm thick cellulose triacetate film support having thereon a subbing layer, to thereby prepare a multi-layered color light-sensitive material Sample 501. The addition amounts are expressed in terms of g/m². The amounts of colloidal silver and silver halides are the coverage amounts expressed in terms of silver. The effects of the added compounds are not limited to their described applications.

First layer: anti-halation layer

| | |
|---|---|
| Black colloidal silver | 0.25 g as Ag |
| Gelatin | 1.9 g |
| UV absorber U-1 | 0.04 g |

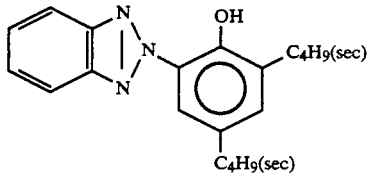

UV absorber U-2 0.1 g

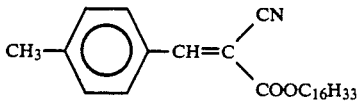

-continued

UV absorber U-3 — 0.1 g

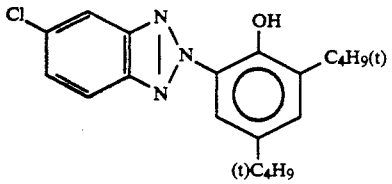

UV absorber U-6 — 0.1 g

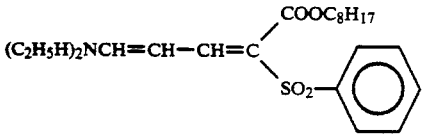

Dibutyl phthalate — 0.1 g

Second layer: intermediate layer

Gelatin — 0.40 g

Compound Cpd-D — 10 mg

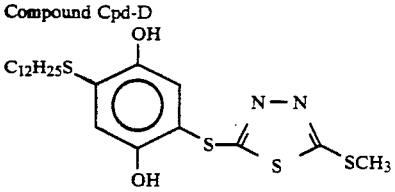

High-boiling solvent — 0.1 g

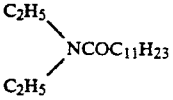

Dye D-4 — 0.4 mg

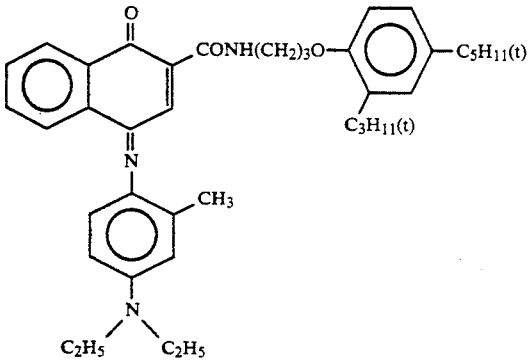

Third layer: intermediate layer

Silver iodobromide fine grains whose surface and inside were fogged (average grain size 0.06 μm, a variation coefficient: 18%, AgI content: 1 mole %) — 0.5 g as Ag Gelatin — 0.4 g Fourth layer: low red-sensitive layer Emulsion A — 0.2 g as Ag Emulsion B — 0.3 g as Ag Gelatin — 0.8 g Coupler C-1 — 0.15 g

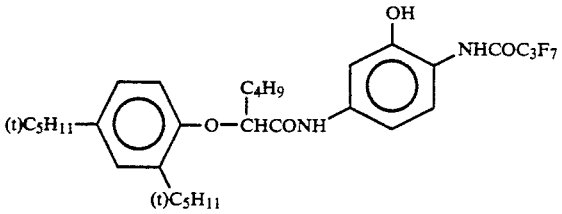

-continued
Coupler C-2 0.05 g
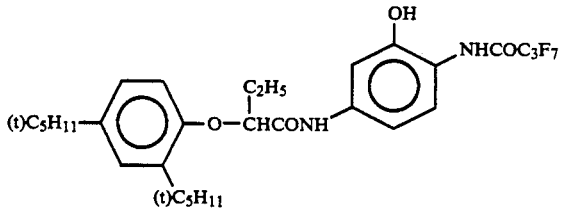
Coupler C-9 0.05 g
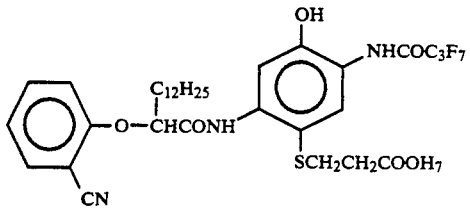
Compound Cpd-D 10 mg
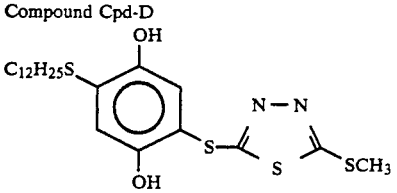
Tricresyl phosphate 0.1 g
Fifth layer: middle red-sensitive layer
| | |
|---|---|
| Emulsion B | 0.2 g as Ag |
| Emulsion C | 0.3 g as Ag |
| Gelatin | 0.8 g |
| Coupler C-1 | 0.2 g |
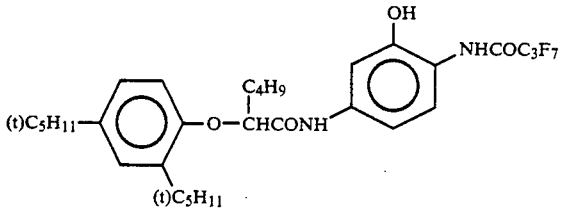
Coupler C-2 0.05 g
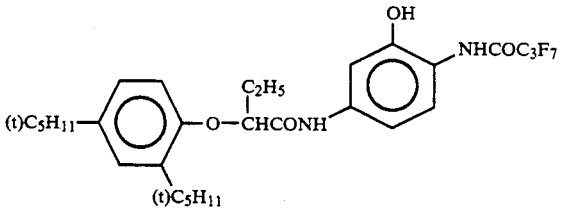
Coupler C-3 0.2 g
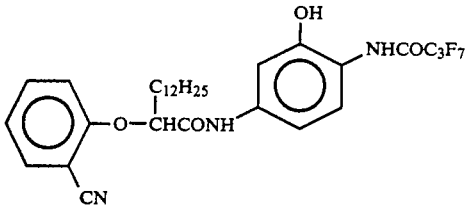
Tricresyl phosphate 0.1 g
Sixth layer: high red-sensitive layer
| | |
|---|---|
| Emulsion D | 0.4 g as Ag |
| Gelatin | 1.1 g |
| Coupler C-1 | 0.3 g |

-continued
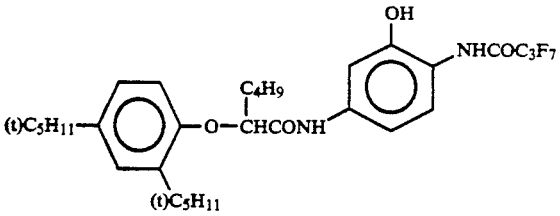
Coupler C-3 0.7 g
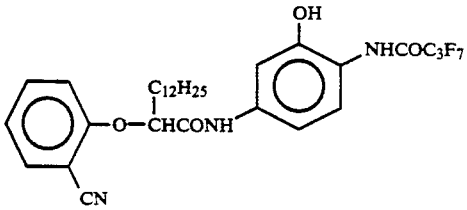
Additive P-1 0.1 g
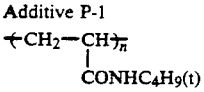
Seventh layer: intermediate layer
Gelatin 0.6 g
Additve M-1 0.3 g
Color-mixing preventing agent Cpd-K 2.6 mg
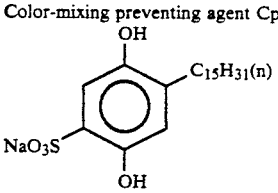
UV absorber U-1 0.1 g
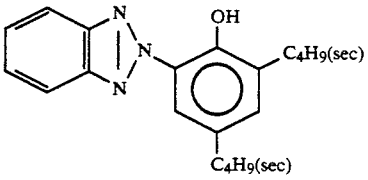
UV absorber U-6 0.1 g
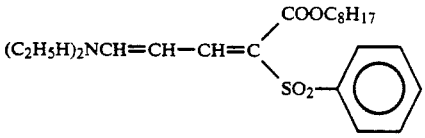
Dye D-1 0.02 g
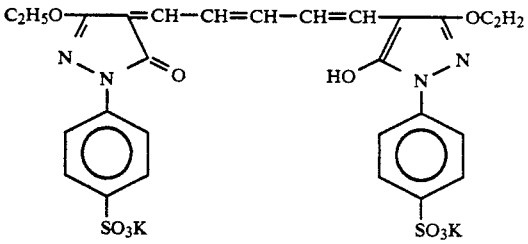
Eighth layer: intermediate layer
Silver iodobromide fine grains whose surface and inside were fogged, (average grain size: 0.06 μm, 0.02 g as Ag -continued
variation coefficient: 16%,
AgI content: 0.3 mole %)
Gelatin 1.0 g
Additive P-1 0.2 g
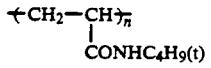
Color-mixing preventing agent Cpd-J 0.1 g
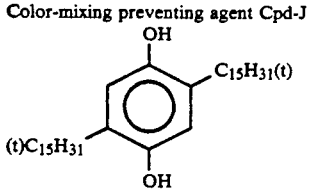
Color-mixing preventing agent Cpd-A 0.1 g
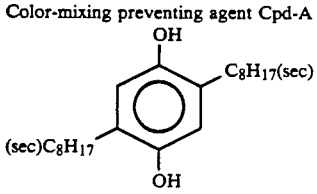
Ninth layer: a low green-sensitive layer
Emulsion E 0.3 g as Ag
Emulsion F 0.1 g as Ag
Emulsion G 0.1 g as Ag
Gelatin 0.5 g
Coupler C-7 0.05 g
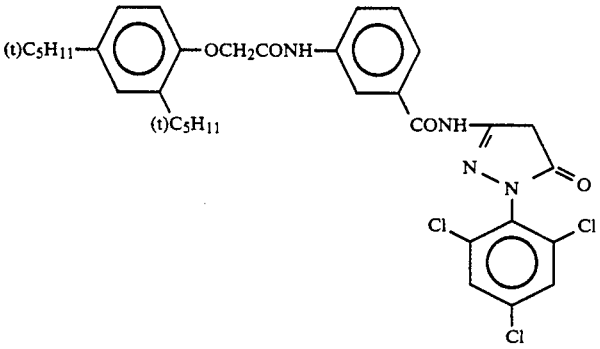
Coupler C-8 0.20 g
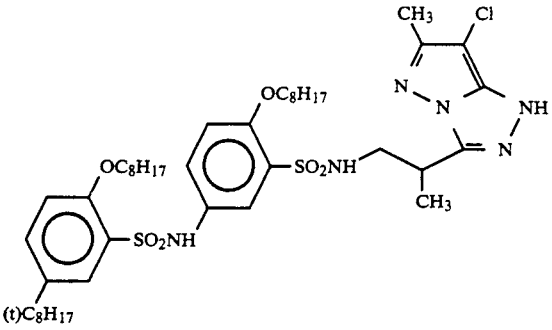
Compound Cpd-B 0.03
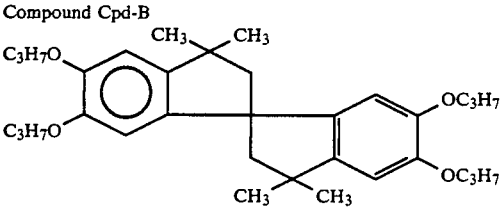
Compound Cpd-D 10 mg -continued
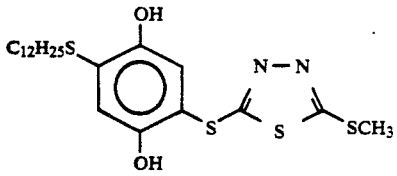
Compound Cpd-E 0.02 g
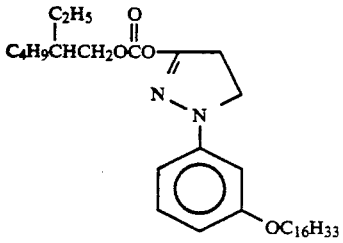
Compound Cpd-F 0.02 g
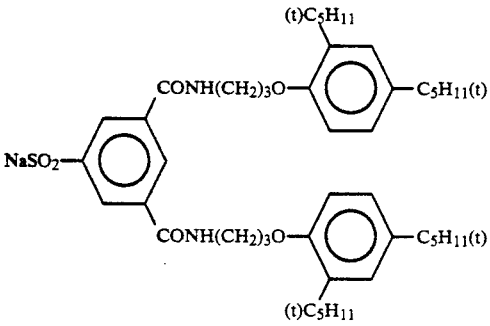
Compound Cpd-G 0.02 g
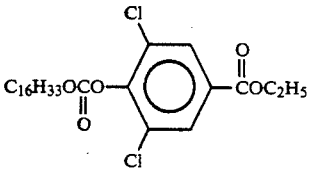
Compound Cpd-H 0.02 g
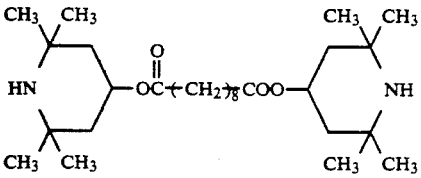
| | |
|---|---|
| Dibutyl phthalate | 0.1 g |
| Tricresyl phosphate | 0.1 g |
Tenth layer: middle green-sensitive layer
| | |
|---|---|
| Emulsion G | 0.3 g as Ag |
| Emulsion H | 0.1 g as Ag |
| Gelatin | 0.6 g |
| Coupler C-7 | 0.2 g |

-continued
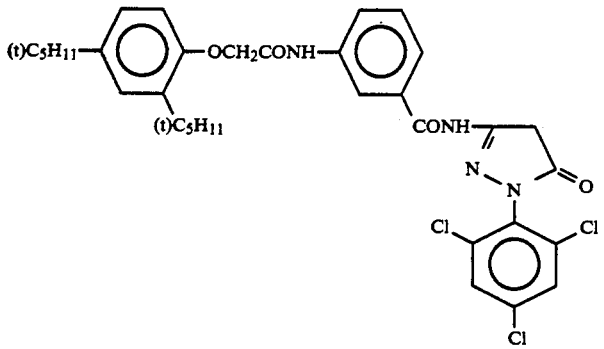
Coupler C-8 0.1 g
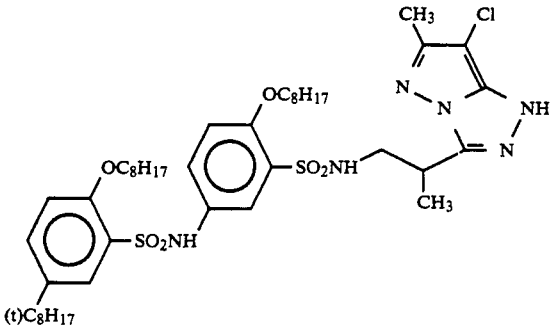
Compound Cpd-B 0.03 g
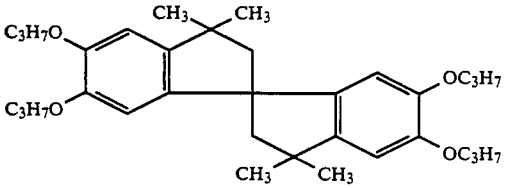
Compound Cpd-E 0.02 g
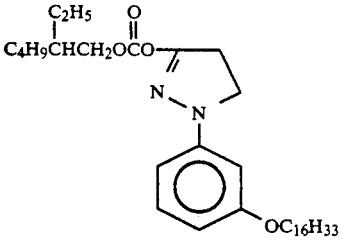
Compound Cpd-F 0.02 g
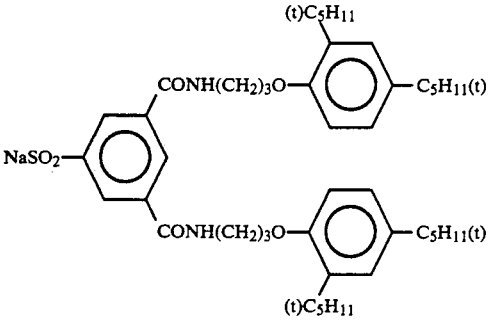
Compound Cpd-G 0.05 g -continued
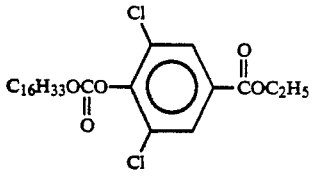
Compound Cpd-H 0.05 g
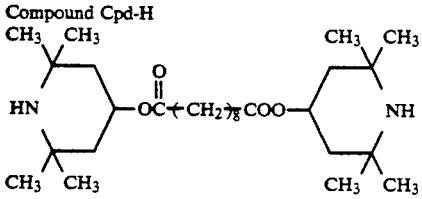
Tricresyl phosphate 0.01 g
Eleventh layer: high green-sensitive layer
Emulsion I 0.5 g as Ag
Gelatin 1.0 g
Coupler C-4 0.3 g
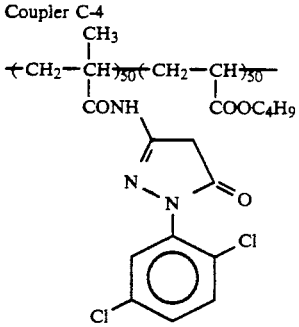
Formula coefficients indicate wt %
Average Molecular Weight: About 25,000
Coupler C-8 0.1 g
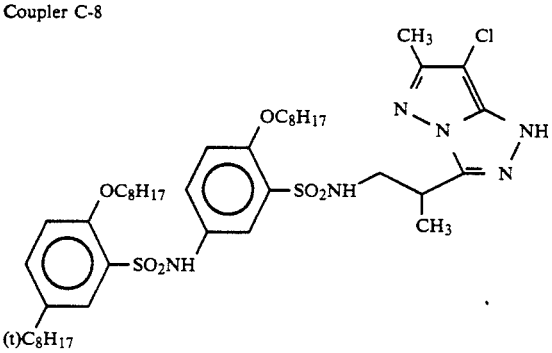
Compound Cpd-B 0.08 g
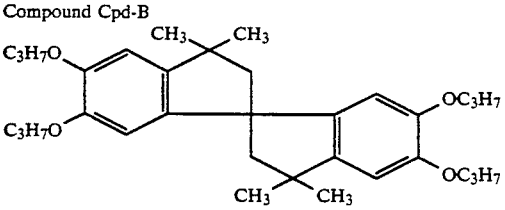
Compound Cpd-E 0.02 g
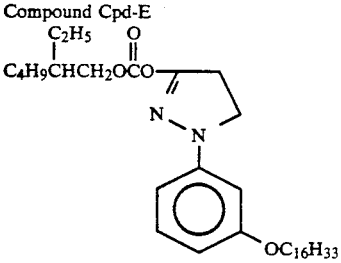
Compound Cpd-F 0.02 g -continued
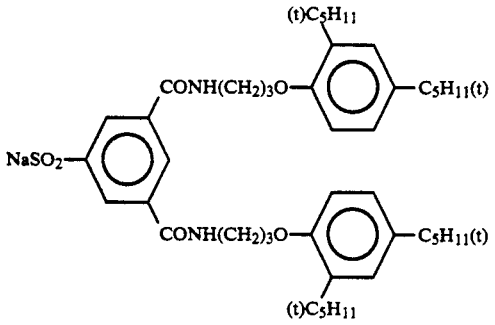
Compound Cpd-G 0.02 g
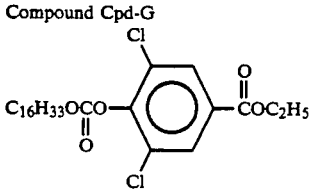
Compound Cpd-H 0.02 g
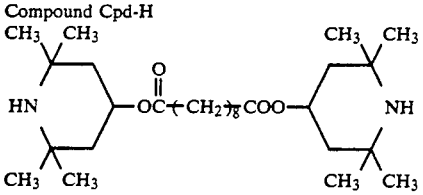
Dibutyl phthalate 0.2 g
Tricresyl phosphate 0.2 g
Twelfth layer: intermediate layer
Gelatin 0.6 g
Dye D-1 0.1 g
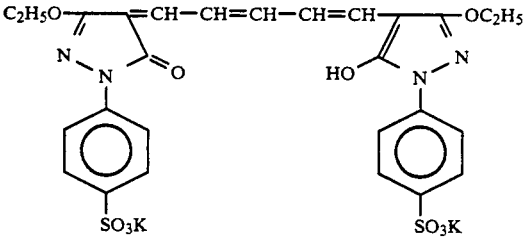
Dye D-2 0.05 g
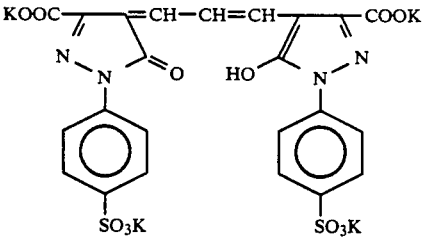
Dye D-3 0.07 g
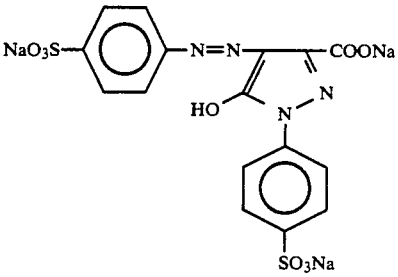

-continued

Thirteenth layer: yellow filter layer

| | |
|---|---|
| Yellow colloidal silver | 0.1 g as Ag |
| Gelatin | 1.1 g |
| Color-mixing preventing agent Cpd-A | 0.01 g |

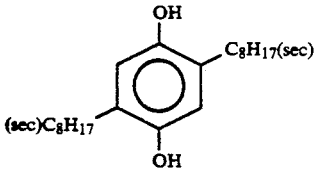

| | |
|---|---|
| Dibutyl phthalate | 0.01 g |

Fourteenth layer: intermediate

| | |
|---|---|
| Gelatin | 0.6 g |

Fifteenth layer: low blue-sensitive layer

| | |
|---|---|
| Emulsion J | 0.4 g as Ag |
| Emulsion K | 0.1 g as Ag |
| Emulsion L | 0.1 g as Ag |
| Gelatin | 0.8 g |
| Coupler C-5 | 0.6 g |

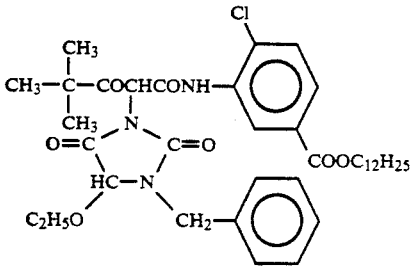

Sixteenth layer: middle blue-sensitive layer

| | |
|---|---|
| Emulsion L | 0.1 g as Ag |
| Emulsion M | 0.4 g as Ag |
| Gelatin | 0.9 g |
| Coupler C-5 | 0.3 g |

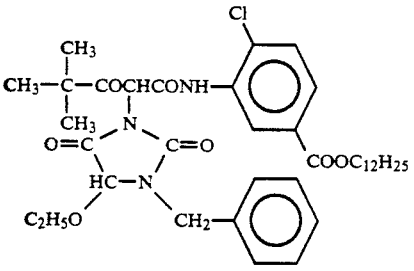

| | |
|---|---|
| Coupler C-6 | 0.3 g |

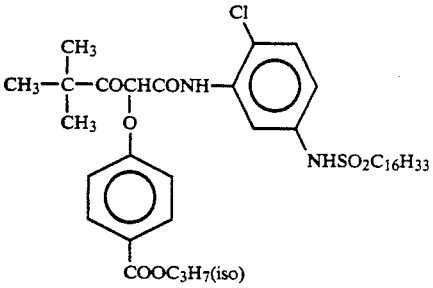

Seventeenth layer: high blue-sensitive layer

| | |
|---|---|
| Emulsion N | 0.4 g as Ag |
| Gelatin | 1.2 g |
| Coupler C-6 | 0.7 g |

-continued
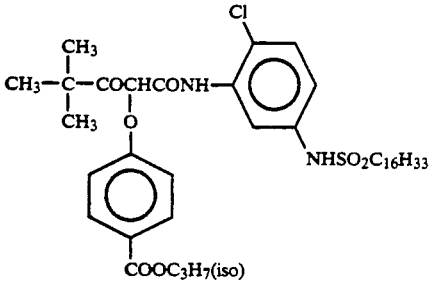
Eighteenth layer: first protective layer
Gelatin 0.7 g
UV absorber U-1 0.04 g
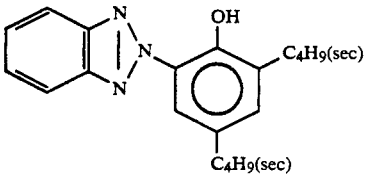
UV absorber U-2 0.01 g
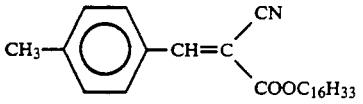
UV absorber U-3 0.03 g
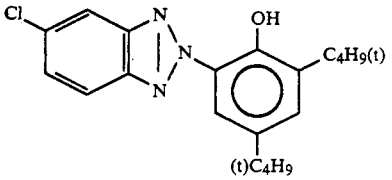
UV absorber U-4 0.03 g
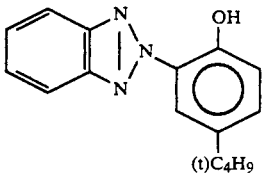
UV absorber U-5 0.05 g
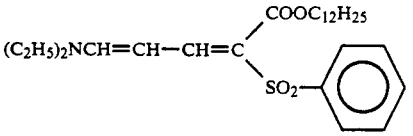
UV absorber U-6 0.05 g
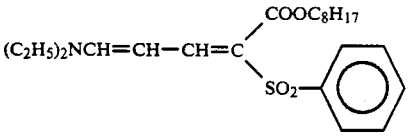
Dibutyl phthalate 0.02 g
Formalin scavenger
Cpd-C 0.2 g
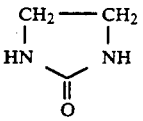

-continued

| | |
|---|---|
| Cpd-1 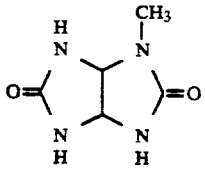 | 0.4 g |
| Dye D-3 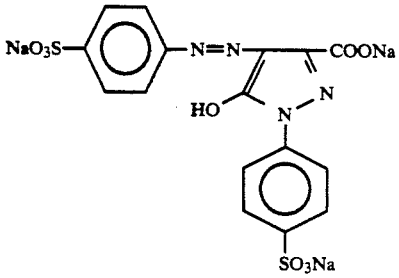 | 0.05 g |
| Nineteenth layer: the second protective layer | |
| Colloidal silver | 0.1 mg as Ag |
| Silver iodobromide fine grains (average grain size: 0.06 μm, AgI content: 1 mole %) | 0.1 g as Ag |
| Gelatin | 0.4 g |
| Twentieth layer: third protective layer | |
| Gelatin | 0.4 g |
| Polymethyl methacrylate (average particle size: 1.5 μm) | 0.1 g |
| Copolymer of methyl methacrylate and acrylic acid (4:6) (average particle size: 1.5 μm) | 0.1 g |
| Silicon oil | 0.03 g |
| Surface active agent W-1 $C_8F_{17}SO_2NHCH_2CH_2CH_2OCH_2CH_2N^{\oplus}(CH_3)_3$ 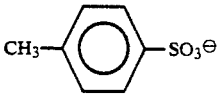 | 3.0 mg |
| Surface active agent W-2 $C_8F_{17}SO_2N(C_3H_7)CH_2COOK$ | 0.03 g |

In addition to the above components, the additives F-1 to F-8 were added to each of the silver halide emulsion layers. Further, a gelatin hardener H-1 and the surface active agents W-3 and W-4 for coating and emulsifying in addition to the above components were added to each of the layers.

F-1

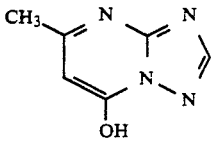

F-2

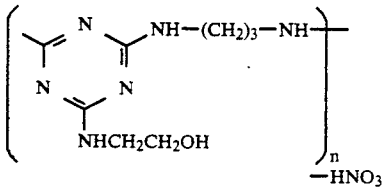

-continued

F-3

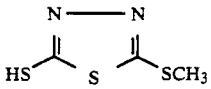

F-4

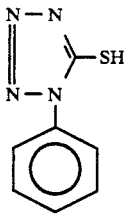

F-5

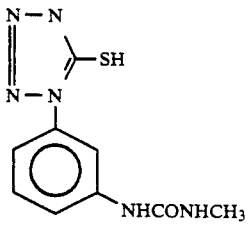

-continued

F-6

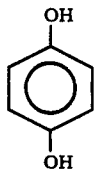

F-7

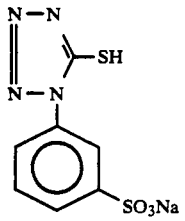

F-8

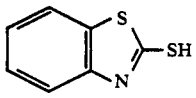

H-1

$CH_2{=}CH{-}SO_2{-}CH_2{-}CONH{-}CH_2$
$CH_2{=}CH{-}SO_2{-}CH_2{-}CONH{-}CH_2$

W-3

$CH_2COOCH_2CH(C_2H_5)C_4H_9$
$NaO_3S{-}CHCOOCH_2CH(C_2H_5)C_4H_9$

W-4

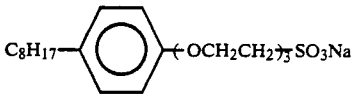

Further, phenol, 1,2-benzisothiazline-3-one, 2-phenoxyethanol and phenethyl alcohol were added as a fungicide and an anti-mold agent.

The silver iodobromide emulsions used to prepare Sample 5-1 are shown in Tables 4 and 5:

TABLE 4

| | Emulsion | Average grain size (μm) | Fluctuation coefficient (%) | AgI content (%) |
|---|---|---|---|---|
| A | Monodispersed tetra-decahedral grains | 0.25 | 16 | 3.7 |
| B | Monodispersed cubic, internal latent image type grains | 0.30 | 10 | 3.3 |
| C | Monodispersed tetra-decahedral grains | 0.30 | 18 | 5.0 |
| D | Polydispersed twinned grains | 0.60 | 25 | 2.0 |
| E | Monodispersed cubic grains | 0.17 | 17 | 4.0 |
| F | Monodispersed cubic grains | 0.20 | 16 | 4.0 |
| G | Monodispersed cubic, internal latent image type grains | 0.25 | 11 | 3.5 |
| H | Monodispersed cubic, internal latent image type grains | 0.30 | 9 | 3.5 |
| I | Polydispersed tabular grains (average aspect ratio: 4.0) | 0.80 | 28 | 1.5 |
| J | Monodispersed tetra-decahedral grains | 0.30 | 18 | 4.0 |
| K | Monodispersed tetra-decahedral grains | 0.37 | 17 | 4.0 |
| L | Monodispersed cubic, internal latent image type grains | 0.46 | 14 | 3.5 |
| M | Monodispersed cubic grains | 0.55 | 13 | 4.0 |
| N | Polydispersed tabular grains (average aspect ratio: 7.0) | 1.00 | 33 | 1.3 |

TABLE 5

Spectral sensitization of Emulsions A to N

TABLE 5-continued

| Emulsion | Sensitizing dye added | Added amount per mol of AgX (g) | Timing for addition of sensitizing dye |
|---|---|---|---|
| A | S-1 | 0.025 | IV |
| | S-2 | 0.25 | IV |
| B | S-1 | 0.01 | II |
| | S-2 | 0.25 | II |
| C | S-1 | 0.02 | IV |
| | S-2 | 0.25 | IV |
| D | S-1 | 0.01 | IV |
| | S-2 | 0.10 | IV |
| | S-7 | 0.01 | IV |
| E | S-3 | 0.5 | IV |
| | S-4 | 0.1 | IV |
| F | S-3 | 0.3 | IV |
| | S-4 | 0.1 | IV |
| G | S-3 | 0.25 | II |
| | S-4 | 0.08 | II |
| H | S-3 | 0.2 | I |
| | S-4 | 0.06 | I |
| I | S-3 | 0.3 | III |
| | S-4 | 0.07 | III |
| | S-8 | 0.1 | III |
| J | S-6 | 0.2 | I |
| | S-5 | 0.05 | I |
| K | S-6 | 0.2 | I |
| | S-5 | 0.05 | I |
| L | S-6 | 0.22 | II |
| | S-5 | 0.06 | II |
| M | S-6 | 0.15 | IV |
| | S-5 | 0.04 | IV |
| N | S-6 | 0.22 | II |
| | S-5 | 0.06 | II |

I: during grain formation
II: immediately after grain formation
III: immediately before the start of chemical sensitization
IV: immediately after completing chemical sensitization

S-1

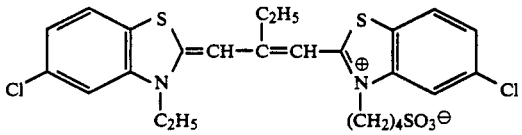

S-2

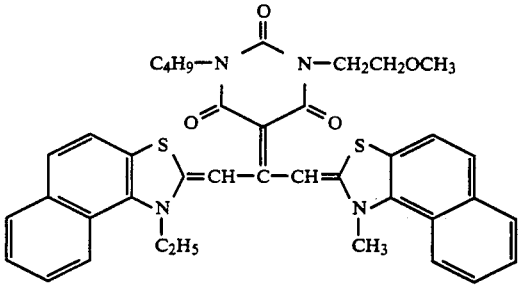

S-3

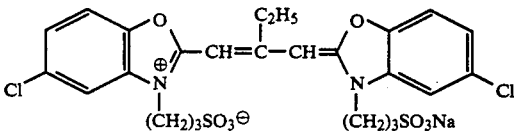

S-4

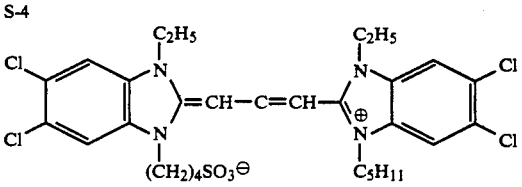

S-5

TABLE 5-continued

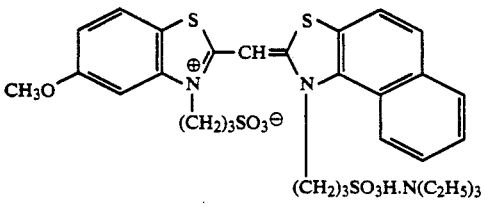

S-6

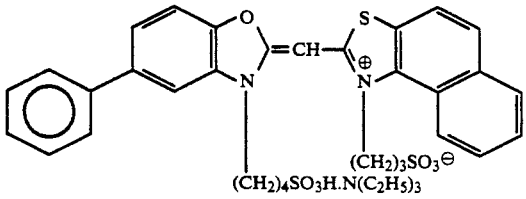

S-7

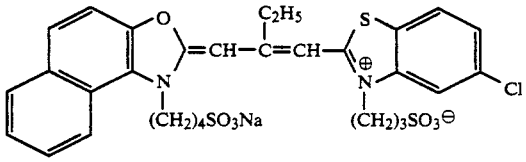

Colloidal silver contained in the thirteenth layer of Sample 5-1 was replaced by the following dye disclosed in published International Patent Application 88/04794, which was dispersed in a solid form together with a surface active agent and water with a ball mill as described in the above publication, wherein the coated amount of the dye was 0.175 g/m$^2$, to thereby obtain Comparative Sample 5-2.

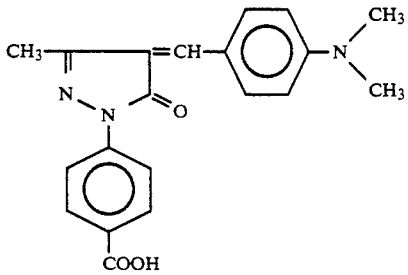

Further, yellow colloidal silver contained in the thirteenth layer of Sample 5-1 was similarly replaced by the compound (4) of the present invention in an amount of 0.253 g m$^2$ dispersed with the following surface active agent in an amount of 0.195 g/m$^2$, to obtain Sample 5-3.

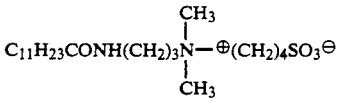

The dispersion was carried out in the same manner as Example 1.

Further, black colloidal silver contained in an antihalation layer of the first layer of Sample 5-1 was replaced by the following dye described in JP-A-52-92716, which was dispersed in a solid form together with water and a surface active agent Triton X-20 with a ball mill, in a the coated amount of 0.150 g/m$^2$. Furthermore, yellow colloidal silver contained in the thirteenth layer was replaced by the same dye as in Sample 5-3, to obtain Sample 5-4.

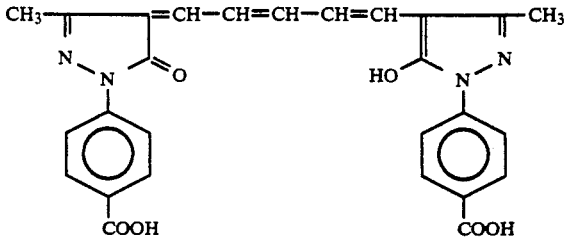

After these samples were cut into strips and imagewise exposed, the samples were developed at 38° C. as described below. The processed strips thus obtained were evaluated with respect to image density.

| Processing steps | | | | |
|---|---|---|---|---|
| Step | Time | Temp. | Tank capacity | Replenishing amount |
| Black-and-white developing | 6 min. | 38° C. | 12 l | 2.2 l/m$^2$ |
| 1st washing | 2 min. | 38° C. | 4 l | 7.5 l/m$^2$ |
| Reversal | 2 min. | 38° C. | 4 l | 1.1 l/m$^2$ |
| Color developing | 6 min. | 38° C. | 12 l | 2.2 l/m$^2$ |
| Bleaching | 3 min. | 38° C. | 6 l | 0.15 l/m$^2$ |
| Fixing | 4 min. | 38° C. | 8 l | 2.2 l/m$^2$ |
| 2nd washing (1) | 2 min. | 38° C. | 4 l | — |
| 2nd washing (2) | 2 min. | 38° C. | 4 l | 7.5 l/m$^2$ |
| Stabilizing | 2 min. | 38° C. | 4 l | 1.1 l/m$^2$ |
| 3rd washing | 1 min. | 38° C. | 4 l | 1.1 l/m$^2$ |

Time: minutes
Replenishing amount: per m$^2$ of the light-sensitive material

The overflow solution of the second washing bath (2) was introduced into the second washing bath (1).

| Black-and-white developing solution | | |
|---|---|---|
| | Mother Solution | Replenishing soln. |
| Pentasodium nitrilo-N,N,N-trimethylenephosphonate | 2.0 g | 2.0 g |
| Pentasodium diethylenetriaminepentacetate | 3.0 g | 3.0 g |
| Potassium sulfite | 30.0 g | 30.0 g |
| Hydroquinone potassium monosulfonate | 20.0 g | 20.0 g |
| Potassium carbonate | 33.0 g | 33.0 g |
| 1-Phenyl-4-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | 2.0 mg |
| Water was added to | 1.0 l | 1.0 l |
| pH (25° C.) | 9.60 | 9.70 |

pH was adjusted with hydrochloric acid or potassium hydroxide.

| Reversal solution | | |
|---|---|---|
| | Mother Solution | Replenishing soln. |
| Pentasodium nitrilo-N,N,N-trimethylenephosphonate | 3.0 g | Same as mother solution |
| Stannous chloride dihydrate | 1.0 g | |
| p-Aminophenol | 0.1 g | |
| Sodium hydroxide | 8.0 | |

-continued

| Reversal solution | Mother Solution | Replenishing soln. |
|---|---|---|
| Glacial acetic acid | 15 ml | |
| Water was added to make | 1.0 liter | |
| pH (25° C.) | 6.00 | |

pH was adjusted with hydrochloric acid or potassium hydroxide.

| Color developing solution | Mother Solution | Replenishing soln. |
|---|---|---|
| Pentasodium nitrilo-N,N,N-trimethylenephosphonate | 2.0 g | 2.0 g |
| Pentasodium diethylenetriaminepentacetate | 2.0 g | 2.0 g |
| Potassium sulfite | 7.0 g | 7.0 g |
| Tripotassium phosphate 12 hydrate | 36.0 g | 36.0 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-(β-methanesulfonamidoethyl)-3-methyl-4-aminoaniline sulfate | 10.5 g | 10.5 g |
| 3,6-Dithiaoctane-1,8-diol | 3.5 g | 35 g |
| Water was added to make | 1.0 l | 1.0 l |
| pH (25° C.) | 11.90 | 12.05 |

pH was adjusted with hydrochloric acid or potassium hydroxide.

| Bleaching solution | Mother Solution | Replenishing soln. |
|---|---|---|
| 1,3-Diaminopropanetetracetic acid | 2.8 g | 4.0 g |
| Ferric ammonium 1,3-diaminopropanetetraacetate monohydrate | 138 g | 207.0 g |
| Ammonium bromide | 80.0 g | 120.0 g |
| Ammonium nitrate | 20.0 g | 30.0 g |
| Hydroxyacetic acid | 50.0 g | 75.0 g |
| Acetic acid | 50.0 g | 75.0 g |
| Water was added to make | 1.0 l | 1.0 l |
| pH (25° C.) | 3.40 | 2.80 |

pH was adjusted with acetic and ammonia water.

| Fixing solution | Mother Solution | Replenishing soln. |
|---|---|---|
| Disodium ethylenediaminetetracetate dihydrate | 1.7 g | Same as mother |
| Sodium benzaldehyde-o-sulfonate | 20.0 g | |
| Sodium bisulfite | 15.0 g | |
| Ammonium thiosulfate (700 g/liter) | 340.0 ml | |
| Imidazole | 28.0 g | |
| Water was added to make | 1.0 l | |
| pH (25° C.) | 4.00 | |

pH was adjusted with acetic acid or ammonia water.

| Stabilizing solution | Mother Solution | Replenishing soln. |
|---|---|---|
| Disodium ethylenediaminetetracetate dihydrate | 1.0 g | Same as mother solution |
| Sodium carbonate | 6.0 g | |
| Formalin (37%) | 5.0 ml | |
| Water was added to make | 1.0 l | |
| pH (25° C.) | 10.00 | |

pH was adjusted with acetic acid or sodium hydroxide.

| Third washing solution | Mother Solution | Replenishing soln. |
|---|---|---|
| Disodium ethylenediaminetetracetate dihydrate | 0.2 g | Same as mother solution |
| Hydroxyethylidene-1,1-diphosphonic acid | 0.05 g | |
| Ammonium acetate | 2.0 g | |
| Sodium dodecylbenzenesulfonate | 0.3 g | |
| pH (25° C.) | 4.50 | |

pH was adjusted with acetic acid or ammonia water.

The sensitivity and maximum density of each sample were shown in Table 6. Both the sensitivity and maximum density are shown relative to that of Comparative Sample 5-1, which was set at 100. R, G and B correspond to red-sensitive, green-sensitive and blue-sensitive, respectively.

TABLE 6

| Sample | Relative sensitivity | | | Maximum density | | |
|---|---|---|---|---|---|---|
| No. | B | G | R | B | G | R |
| 5-1 (Comp.) | 0 | 0 | 0 | 0 | 0 | 0 |
| 5-2 (Comp.) | +0.01 | −0.03 | −0.05 | +0.29 | +0.27 | +0.04 |
| 5-3 (Inv.) | +0.01 | +0.08 | +0.02 | +0.27 | +0.25 | +0.04 |
| 5-4 (Inv.) | +0.01 | +0.06 | +0.02 | +0.27 | +0.27 | +0.14 |

As seen from the results shown in Table 6, the compounds of the present invention provide increased maximum density and have a sharp absorption characteristic. Particularly, the sensitivity of a silver halide emulsion arranged below a filter layer containing the dye of the present invention as a filter dye is increased relative to the same emulsion layer arranged below a filter layer containing a conventional dye as a filter dye.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon one or more hydrophilic colloid layers, at least one layer of which is a light-sensitive silver halide emulsion layer, at least one of said one or more hydrophilic colloid layers containing at least one compound represented by formula (I):

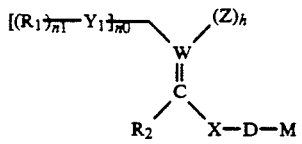

(I)

wherein $R_1$ and $R_2$ each represents a hydrogen atom or a substitutable group; W represents a nitrogen atom or a carbon atom; Z represents $—Y_1—(R_3)n_2$ or $R_3$ in which $R_3$ represents a hydrogen atom or a substitutable group; $n_0$, $n_1$ and $n_2$ each represents 0 or 1; h represents 1 or 2; $R_1$ and $R_2$ and $R_3$ may combine with each other to form a hydrocarbon ring or a heterocyclic ring; $Y_1$ represents —CO—, $—CO(=NR_4)—$, —C(=S)—, $—C(=N^+R_5R_6)—$, —SO—, $—SO_2—$, $—C(C=CR_7R_8)—$, $—R_6C=N—$, or $—R_6C=CR_9—$ in $[(R_1)_{n1}—Y_1]$ when $n_1$ is 1 and in $—Y_1—(R_3)_{n2}$ when $n_2$ is 1 in which $R_4$, $R_5$, $R_6$, $R_7$, $R_8$ and $R_9$ each represents a hydrogen atom or a substitutable group, $Y_1$ represents a cyano group or a nitro group in $[(R_1)_{n1}—Y_1]$ when $n_1$ is 0 and in $—Y_1—(R_3)_{n2}$ when $n_2$ is 0; X represents a divalent linkage group; D represents a photographic dye residue; and M represents a group having a cationic group and an anionic group, wherein M is represented by one of

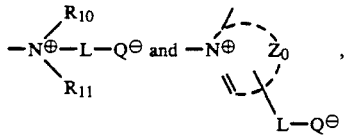

where $R_{10}$ and $R_{11}$ each represents a substituted or unsubstituted alkyl group having 1 to 6 carbon atoms, an aromatic group having 6 to 10 carbon atoms, an acyl group having 2 to 10 carbon atoms, a sulfonyl group having 1 to 10 carbon atoms; $R_{10}$ and $R_{11}$ may combine to form a hetero ring; L represents a divalent linkage group; $Z_0$ represents a group of atoms necessary to form a 5 to 7-membered hetero ring; and Q represents an anion of carboxylic acid, sulfonic acid, sulfinic acid or phosphoric acid.

2. A silver halide photographic light-sensitive material as in claim 1, wherein the substitutable group represented by $R_1$ provided on a 127 μm thick of an alkyl group having 1 to 20 carbon atoms, an alkenyl group having 2 to 20 carbon atoms, an aryl group having 6 to 20 carbon atoms, an alkoxy group having 1 to 20 carbon atoms, an aryloxy group having 6 to 20 carbon atoms, an alkylthio group having 1 to 20 carbon atoms, an arylthio group having 6 to 20 carbon atoms, an unsubstituted amino group, a secondary or tertiary amino group substituted with an alkyl group having 1 to 20 carbon atoms or an aryl group having 6 to 20 carbon atoms, and a hydroxy group.

3. A silver halide photographic light-sensitive material as in claim 1, wherein the substitutable group represented by $R_2$ and $R_3$ is selected from the group consisting of a halogen atom, an alkyl group having 1 to 20 carbon atoms, an aryl group having 6 to 20 carbon atoms, an alkoxy group having 1 to 20 carbon atoms, an aryloxy group having 6 to 20 carbon atoms, an alkylthio group having 1 to 20 carbon atoms, an arylthio group having 6 to 20 carbon atoms, an acyloxy group having 2 to 20 carbon atoms, an unsubstituted amino group, a secondary or tertiary amino group substituted with an alkyl group having 1 to 20 carbon atoms or an aryl group having 6 to 20 carbon atoms, a carbonamide group, a ureido group, a carboxy group, a carbonic acid ester group, an oxycarbonyl group, a carbamoyl group, an acyl group, a sulfonyl group, a sulfinyl group, a sulfamoyl group, a cyano group, and a nitro group.

4. A silver halide photographic light-sensitive material as in claim 1, wherein the substitutable group represented by $R_4$, $R_5$, $R_6$, $R_7$, $R_8$ and $R_9$ is selected from the group consisting of a halogen atom, an alkyl group having 1 to 20 carbon atoms, an alkenyl group having 2 to 20 carbon atoms, an aryl group having 6 to 20 carbon atoms, an alkoxy group having 1 to 20 carbon atoms, an aryloxy group having 6 to 20 carbon atoms, and an acyloxy group having 2 to 20 carbon atoms, and an unsubstituted amino group, a secondary or tertiary amino group substituted with an alkyl group having 1 to 20 carbon atoms or an aryl group having 6 to 20 carbon atoms, a carbonamide group, a ureido group, an oxycarbonyl group, a carbamoyl group, an acyl group, a sulfonyl group, a sulfinyl group, a sulfamoyl group, a cyano group, and a nitro group.

5. A silver halide photographic light-sensitive material as in claim 1, wherein the dye residue represented by D is derived from a dye selected from the group consisting of an arylidene dye, a styryl dye, a butadiene dye, an oxonol dye, a cyanine dye, a merocyanine dye, a hemicyanine dye, a diaryl methane dye, a triaryl methane dye, an azomethine dye, an azo dye, a metal chelate dye, an anthraquinone dye, a stilbene, a chalcone dye, an indophenol dye, an indoaniline dye, and a coumarin dye.

6. A silver halide photographic light-sensitive material as in claim 1, wherein X is selected from the group consisting of —O—, —OCO—, $—SO_2—$, and $—SO_3—$.

7. A silver halide photographic light-sensitive material as in claim 1, wherein the compound represented by formula (I) is represented by formula IV:

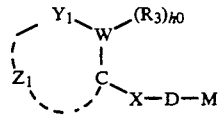

wherein $Z_1$ represents a group of atoms necessary for forming a hydrocarbon ring or a hetero ring; $h_0$ is 0 or 1; and $Y_1$, W, $R_3$, X, D and M have the same meaning as defined for formula (I).

8. A silver halide photographic light-sensitive material as in claim 7, wherein the ring formed with $Z_1$ is selected from the group consisting of a cyclopentenone ring, a cyclohexenone ring, a quinone ring, a coumarin ring, a chromone ring, a uracil ring, and a nitrogen-containing aromatic hetrocyclic ring.

9. A silver halide photographic light-sensitive material as in claim 1, wherein the compound represented for formula (I) is contained in the light-sensitive material an amount of from $10^{-3}$ to 3.0 g/m$^2$.

10. A silver halide photographic light-sensitive material as in claim 1, wherein the compound represented by formula (I) is represented by formula (V):

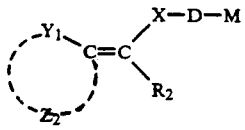

(V)

wherein $Z_2$ represents a group of atoms necessary for forming a hydrocarbon ring or a hetero ring; and $Y_1$, $R_2$, X, D and M have the same meaning as defined for formula (I).

11. A silver halide photographic light-sensitive material as in claim 10, wherein the ring formed with $Z_2$ is selected from the group consisting of a cyclopentenone ring, a cyclohexenone ring, a quinone ring, a coumarin ring, a chromone ring, a uracil ring, and a nitrogen-containing aromatic heterocyclic ring.

12. A silver halide photographic light-sensitive material comprising a support having thereon one or more hydrophilic colloid layers, at least one layer of which is a light-sensitive silver halide emulsion layer, at least one of said one or more hydrophilic colloid layers containing at least one compound represented by formula (I):

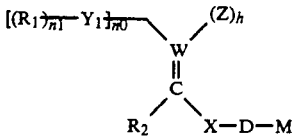

(I)

wherein $R_1$ and $R_2$ each represents a hydrogen atom or a substitutable group; W represents a nitrogen atom or a carbon atom; Z represents $—Y_1—(R_3)n_2$ or $R_3$ in which $R_3$ represents a hydrogen atom or a substitutable group; $n_0$, $n_1$ and $n_2$ each represents 0 or 1; h represents 1 or 2; $R_1$ and $R_2$ and $R_3$ may combine with each other to form a hydrocarbon ring or a heterocyclic ring; $Y_1$ represents —CO—, $—CO(=NR_4)—$, —C(=S)—, $—C(=N^+R_5R_6)—$, —SO—, $—SO_2—$, $—C(C=CR_7R_8)—$, $—R_6C=N—$, or $—R_6C=CR_9—$ in $[(R_1)_{n1}—Y_1]$ when $n_1$ is 1 and in $—Y_1—(R_3)_{n2}$ when $n_2$ is 1 in which $R_4$, $R_5$, $R_6$, $R_7$, $R_8$ and $R_9$ each represents a hydrogen atom or a substitutable group, $Y_1$ represents a cyano group or a nitro group in $[(R_1)_{n1}—Y_1]$ when $n_1$ is 0 and in $—Y_1—(R_3)_{n2}$ when $n_2$ is 0; X represents a divalent linkage group; D represents a photographic dye residue; and M represents a group having a cationic group and an anionic group, wherein M is represented by one of

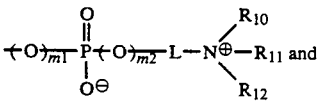

-continued

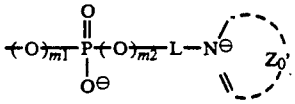

wherein $R_{10}$, $R_{11}$ and $R_{12}$ each represents a substituted or unsubstituted alkyl group having 1 to 6 carbon atoms, an aromatic group having 6 to 10 carbon atoms, an acyl group having 2 to 10 carbon atoms, a sulfonyl group having 1 to 10 carbon atoms; $R_{10}$, $R_{11}$ and $R_{12}$ may combine to form a hetero ring; L represents a divalent linkage group; $Z_0$ represents a group of atoms necessary to form a 5 to 7-membered hetero ring; and $m_1$ and $m_2$ are each 0 or 1, provided that $m_1+m_2$ is 1.

13. A silver halide photographic light-sensitive material as in claim 12, wherein the compound represented by formula (I) is represented by formula (IV):

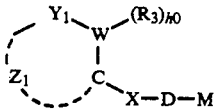

(IV)

wherein $Z_1$ represents a group of atoms necessary for forming a hydrocarbon ring or a hetero ring; $h_0$ is 0 or 1; and $Y_1$, W, $R_3$, X, D and M have the same meaning as defined for formula (I).

14. A silver halide photographic light-sensitive material as in claim 13, wherein the ring formed with $Z_1$ is selected from the group consisting of a cyclopentenone ring, a cyclohexenone ring, a quinone ring, a coumarin ring, a chromone ring, a uracil ring, and a nitrogen-containing aromatic heterocyclic ring.

15. A silver halide photographic light-sensitive material as in claim 12, wherein the compound represented by formula (I) is represented by formula (V):

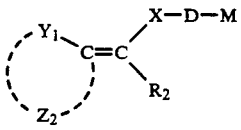

(V)

wherein $Z_2$ represents a group of atoms necessary for forming a hydrocarbon ring or a hetero ring; and $Y_1$, $R_2$, X, D and M have the same meaning as defined for formula (I).

16. A silver halide photographic light-sensitive material as in claim 15, wherein the ring formed with $Z_2$ is selected from the group consisting of a cyclopentenone ring, a cyclohexenone ring, a quinone ring, a coumarin ring, a chromone ring, a uracil ring, and a nitrogen-containing aromatic heterocyclic ring.

* * * * *